US008628362B2

(12) United States Patent
Maki

(10) Patent No.: US 8,628,362 B2
(45) Date of Patent: Jan. 14, 2014

(54) CONNECTOR WITH ELASTIC DEFORMATION MEMBER

(75) Inventor: Kentaro Maki, Tokyo (JP)

(73) Assignee: Hirose Electric Co., Ltd, Tokyo (JP)

( * ) Notice: Subject to any disclaimer, the term of this patent is extended or adjusted under 35 U.S.C. 154(b) by 113 days.

(21) Appl. No.: 13/432,354

(22) Filed: Mar. 28, 2012

(65) Prior Publication Data

US 2012/0252282 A1 Oct. 4, 2012

(30) Foreign Application Priority Data

Mar. 28, 2011 (JP) ..... 2011-069657

(51) Int. Cl.
*H01R 11/09* (2006.01)

(52) U.S. Cl.
USPC ..... 439/784; 439/347

(58) Field of Classification Search
USPC ..... 439/784, 347, 152, 312, 351, 352
See application file for complete search history.

(56) References Cited

U.S. PATENT DOCUMENTS

| | | | | | |
|---|---|---|---|---|---|
| 2,565,572 | A | * | 8/1951 | Pangborn | 285/277 |
| 3,077,330 | A | * | 2/1963 | Lampbear | 251/89.5 |
| 3,964,771 | A | * | 6/1976 | Baudouin | 285/315 |
| 3,976,313 | A | * | 8/1976 | Lauffenburger et al. | 285/84 |
| 4,294,475 | A | * | 10/1981 | Kanai et al. | 285/145.4 |
| 4,367,797 | A | * | 1/1983 | Brown | 166/380 |
| 4,422,716 | A | * | 12/1983 | Morimoto et al. | 385/78 |
| 4,433,889 | A | * | 2/1984 | Ratchford et al. | 439/272 |
| 4,462,652 | A | * | 7/1984 | Werth et al. | 439/312 |
| 4,493,520 | A | * | 1/1985 | Davies | 439/350 |
| 4,533,194 | A | * | 8/1985 | Boichut et al. | 439/347 |
| 4,548,455 | A | * | 10/1985 | Ezure | 439/152 |
| 4,606,559 | A | * | 8/1986 | Rammelsberg | 285/39 |
| 4,804,242 | A | * | 2/1989 | Hasegawa et al. | 385/69 |
| 4,822,082 | A | * | 4/1989 | Phillipps | 285/334.1 |
| 5,595,499 | A | * | 1/1997 | Zander et al. | 439/352 |
| 6,073,974 | A | * | 6/2000 | Meisinger et al. | 285/86 |
| 6,129,334 | A | * | 10/2000 | Kuwabara | 251/149.6 |
| 7,494,158 | B2 | * | 2/2009 | Weh et al. | 285/322 |
| 7,568,934 | B1 | * | 8/2009 | Williams et al. | 439/271 |
| 7,883,117 | B2 | * | 2/2011 | Marc et al. | 285/86 |
| 8,021,181 | B2 | * | 9/2011 | Montena et al. | 439/352 |

FOREIGN PATENT DOCUMENTS

JP 2003-516606 A 5/2003

* cited by examiner

*Primary Examiner* — Amy Cohen Johnson
*Assistant Examiner* — Vladimir Imas
(74) *Attorney, Agent, or Firm* — Kubotera & Associates, LLC

(57) ABSTRACT

A connector to be connected to a mating connector, includes a connector main body including a cylindrical member, a supporting member disposed in the cylindrical member, a terminal supported on the supporting member, and a fitting portion having an engaging portion; a movable sleeve including a diameter control portion; an elastic deformation member disposed to be elastically deformable in a radial direction thereof; an accommodating portion disposed between the connector main body and the movable sleeve for accommodating the elastic deformation member; and a transmission unit for transmitting a force in the axial direction from the movable sleeve to the elastic deformation member when the movable sleeve moves, and for transmitting a force in the radial direction from the elastic deformation member to the movable sleeve when the elastic deformation member returns to an original shape.

7 Claims, 9 Drawing Sheets

CONNECTOR WITH ELASTIC DEFORMATION MEMBER

BACKGROUND OF THE INVENTION AND RELATED ART STATEMENT

The present invention relates to a connector. More specifically, the present invention relates to a connector such as an electrical connector for connecting devices electrically, in which a locking mechanism is provided for preventing the connector from coming off.

In a conventional connector such as an electrical connector, an optical connector, and so on, a locking mechanism is provided therein for preventing the connector connected to a mating connector from coming off the mating connector. For example, a connector having a circular cross-sectional shape such as a coaxial connector, a multi core connector, and so on, is equipped with the various locking mechanisms such as a screw-in style mechanism, a bayonet style mechanism, a push-pull style mechanism, and so on.

In the conventional connectors described above, the locking mechanism of the push-pull style includes a sleeve having a cylindrical shape on an outer circumference of a connector main body. The sleeve is capable of moving and sliding in a direction of an axis of the connector main body. When an operator unlocks the connector, the operator moves the sleeve in the direction of the axis by holding the sleeve with fingers thereof. When the fingers of the operator are released from the sleeve, the sleeve returns to an initial position automatically, thereby locking the connector.

In the conventional connector equipped with the locking mechanism of the push-pull style, when the connector is connected to the mating connector, the operator holds the sleeve of the connector with the fingers. Then, the operator applies a force so as to push the connector toward the mating connector in the direction of the axis. Accordingly, the sleeve moves to a distal end side of the connector in the direction of the axis. Thereby, the connector is unlocked and the connector becomes capable of connecting to the mating connector. As a result, the connector is connected to the mating connector as is. Further, the sleeve returns to the initial position as the fingers of the operator are released from the sleeve, thereby locking the connector.

When the operator extracts the connector from the mating connector, the operator holds the sleeve with the fingers thereof and applies a force so as to pull the connector out of the mating connector in the direction of the axis. Thereby, the sleeve moves to a proximal end side of the connector so that the connector is disengaged. Therefore, the connector is extracted from the mating connector as is.

As described above, in the conventional connector, the locking mechanism of the push-pull style enables to unlock the connector by simply holding the sleeve then applying the force in the direction that the connector is connected or extracted. Further, the locking mechanism of the push-pull style enables to lock the connector automatically by releasing the sleeve. On the other hand, when the connector is equipped with the locking mechanism of the screw-in style or the bayonet-style, it is necessary to rotate the sleeve thereof around the axis for locking or unlocking the connector. Therefore, the connector equipped with the locking mechanism of the push-pull style can be connected or extracted more easily, as compared to the connectors equipped with the locking mechanisms of the screw-in style and the bayonet-style.

As described above, the sleeve of the connector with the locking mechanism of the push-pull style automatically returns from a position being moved to the initial position as the operator releases the sleeve. It is attained since the connector is provided with a mechanism therein for returning the sleeve which is moved in the direction of the axis to the initial position. For example, when the connector includes a coil spring therein so that the coil spring is able to expand and contract in the direction of the axis, the sleeve returns to the initial position automatically.

More specifically, when the operator holds and moves the sleeve with the fingers thereof from the initial position in the direction of the proximal end side or the distal end side, the coil spring contracts with elasticity thereof. Further, when the operator releases the fingers from the sleeve, the coil spring expands with elasticity thereof. Accordingly, when a force generated by the expansion of the coil spring is applied to the sleeve, the sleeve returns to the initial position automatically.

Further, Patent Reference discloses a conventional connector having a mechanism for returning a locking sleeve to an initial position utilizing elasticity.

In the conventional connector disclosed in Patent Reference, the mechanism includes a locking sleeve and an elastic portion provided on other end of the locking sleeve. When a cam formed in the elastic portion contacts with a surface (a concaved portion with a slightly inclined surface) formed in an outer circumferential portion on the other end of a coupler, the elastic portion is deformed outward in a direction of a diameter thereof as the locking sleeve is moved from the initial position toward an end or the other end. Thereby, the locking sleeve returns to the initial position by utilizing the elasticity of the elastic portion.

Patent Reference Japanese Patent Publication No. 2003-516606

As described above, the conventional connector having the locking mechanism of the push-pull style includes the mechanism for returning the sleeve moved in the direction of the axis to the initial position. However, the mechanism described above has problems described below.

When the mechanism for returning the sleeve automatically to the initial position is configured with the coil spring as described above, the connector needs to include the coil spring, a spring washer, a space to expand and contract of the coil spring, and so on therein. As a result, a dimension of the connector in the direction of the axis becomes larger. Therefore, the connector becomes larger in size.

Further, as disclosed in Patent Reference, when the connector is equipped with the mechanism configured with the locking sleeve and the elastic portion provided on the other end of the locking sleeve, the connector becomes larger in size since the dimension of the connector in the direction of the axis also becomes larger.

More specifically, the elastic portion needs to have a certain length in the direction of the axis in order to obtain proper elasticity generated by deformation thereof. When the elastic portion has a short length as described in Patent Reference, the elastic portion tends to generate an excessive elastic force toward outside in the direction of the diameter. Consequently, a strong force is required to move the sleeve in the direction of the axis. As a result, it becomes difficult to lock and unlock easily. According to simulation, the elastic portion may need to be twice as long in the direction of the axis as disclosed in Patent Reference in order to obtain preferred operability for locking and unlocking.

Furthermore, in the conventional connector, when the mechanism for returning the sleeve to the initial position is configured with the locking sleeve and the elastic portion provided on the other end of the locking sleeve as disclosed in Patent Reference, it is difficult to provide the connector with proper durability and reduce the size of the connector.

More specifically, in the conventional connector disclosed in Patent Reference, the elastic portion has a shape of a collet chuck. Thereby, the elastic portion is capable of elastically deforming toward outside in the direction of the diameter. On the other hand, rigidity of the elastic portion becomes less strong consequently, since the elastic portion has a shape of a collet chuck. As a result, the connector is not able to obtain the sufficient durability.

Generally, when the connector is handled normally, the connector often receives an external force. For example, the elastic portion receives a force due to a forcible twisting upon extraction of the connector, or an external force generated as a cable connected to the other end of the connector is pulled in a direction crossing the direction of the axis of the connector. It is difficult for the elastic portion having the shape of the collet chuck to have sufficient durability against the forcible twisting or the external force described above.

In view of the problems described above, an object of the present invention is to provide a connector capable of reducing a size thereof, especially a size thereof in a direction of an axis thereof, as well as being equipped with a locking mechanism.

A further object of the present invention is to provide a connector having a locking mechanism including a sufficiently rigid movable sleeve arranged to be movable in the direction of the axis for locking and unlocking the connector, so that the connector is sufficiently durable and capable of preventing the movable sleeve thereof from being damaged or deformed due to the forcible twisting and so on.

Further objects and advantages of the invention will be apparent from the following description of the invention.

SUMMARY OF THE INVENTION

In order to attain the objects described above, according to a first aspect of the present invention, a first connector is to be connected to a mating connector.

According to the first aspect of the present invention, the connector includes a connector main body including a cylindrical member formed in a cylindrical shape, a supporting member disposed in the cylindrical member, a terminal supported on the supporting member on a proximal end side of the cylindrical member and extending in an axial direction, and a fitting portion formed on a distal end side of the cylindrical member for receiving the mating connector and engaging with the mating connector.

According to the first aspect of the present invention, the fitting portion is arranged to be elastically deformable to increase a diameter thereof. Further, the fitting portion has an engaging portion on an inner circumference side thereof. When the mating connector starts entering the fitting portion, the fitting portion expands in the radial direction thereof, so that the mating connector is allowed to enter the fitting portion. Further, when the mating connector is completely inserted into the fitting portion, the fitting portion returns to an original shape thereof, and the engaging portion engages with an engaged portion formed on the mating connector.

According to the first aspect of the present invention, the connector further includes a movable sleeve formed in a ring shape and disposed on an outer circumference side of the connector main body to be movable along the axial direction thereof relative to the connector main body. The movable sleeve including a diameter control portion at the distal end side for controlling an expansion of the fitting portion in the radial direction. When the movable sleeve is situated at an initial position, the diameter control portion moves close to or contacts with an outer circumferential portion of the fitting portion, so that the fitting portion is not capable of expanding in the radial direction. Further, when the movable sleeve moves toward the distal end side or the proximal end side from the initial position along the axial direction, the diameter control portion moves away from the outer circumferential portion of the fitting portion, so that the fitting portion is capable of expanding in the radial direction.

According to the first aspect of the present invention, the connector further includes an elastic deformation member formed in a substantially ring shape and disposed to be elastically deformable in a radial direction thereof; and an accommodating portion disposed between an outer circumferential portion of the connector main body on the proximal end side and an inner circumferential portion of the movable sleeve on the proximal end side for accommodating the elastic deformation member in a state that the fitting portion is capable of expanding in the radial direction.

According to the first aspect of the present invention, the connector further includes a transmission unit for converting a force in the axial direction generated when the movable sleeve moves toward the distal end side or the proximal end side from the initial position along the axial direction into a force in the radial direction for deforming the elastic deformation member, and for transmitting the force in the radial direction to the elastic deformation member. The transmission unit is further provided for converting the force in the radial direction to restore the elastic deformation member from the deformed state into the force in the axial direction to return the movable sleeve moves from the distal end side or the proximal end side to the initial position along the axial direction, and for transmitting the force in the axial direction to the movable sleeve.

According to the first aspect of the present invention, when the connector is connected to the mating connector, an operator holds the movable sleeve with fingers, and pushes the connector towards the mating connector in a state that the distal end portion of the fitting portion of the connector contacts with a distal end portion of the mating connector. With the force in the axial direction, the movable sleeve of the connector moves from the initial position to the distal end side in the axial direction.

According to the first aspect of the present invention, the transmission unit is provided for converting the force in the axial direction generated when the movable sleeve moves toward the distal end side along the axial direction into the force in the radial direction, and for transmitting the force in the radial direction to the elastic deformation member. Accordingly, the elastic deformation member deforms in the radial direction. Further, when the movable sleeve moves from the initial position, the diameter control portion moves away from the outer circumferential portion of the fitting portion, so that the fitting portion is capable of expanding in the radial direction.

According to the first aspect of the present invention, when the fitting portion expands in the radial direction, the mating connector can be inserted into the fitting portion. When the mating connector enters up to a back side of the fitting portion and is completely inserted into the fitting portion, the fitting portion contracts and returns to the original shape. Accordingly, the engaging portion engages with the engaged portion of the mating connector.

According to the first aspect of the present invention, when the operator releases the fingers from the movable sleeve, the force in the axial direction to move the movable sleeve toward the distal end side in the axial direction disappears. As a result, the force in the radial direction transmitted to the elastic deformation member disappears, so that the elastic deformation member returns to the original shape thereof with own elastic force.

At this moment, the transmission unit is provided for converting the force in the radial direction to return the elastic deformation member to the original shape into the force in the axial direction to return the movable sleeve moves from the distal end side to the initial position along the axial direction, and for transmitting the force in the axial direction to the movable sleeve. Accordingly, the movable sleeve at the distal end side in the axial direction automatically returns to the initial position.

According to the first aspect of the present invention, when the connector is disconnected from the mating connector, the operator holds the movable sleeve with the fingers, and pulls the connector away from the mating connector. With the force in the axial direction, the movable sleeve of the connector moves from the initial position to the proximal end side in the axial direction.

According to the first aspect of the present invention, the transmission unit is provided for converting the force in the axial direction to move the movable sleeve toward the proximal end side along the axial direction into the force in the radial direction, and for transmitting the force in the radial direction to the elastic deformation member. Accordingly, the elastic deformation member deforms in the radial direction. Further, when the movable sleeve moves from the initial position, the diameter control portion moves away from the outer circumferential portion of the fitting portion, so that the fitting portion is capable of expanding in the radial direction. Accordingly, the engaging portion is disengaged from the engaged portion of the mating connector, and the mating connector is pulled out from the fitting portion.

According to the first aspect of the present invention, when the operator releases the fingers from the movable sleeve, the force in the axial direction to move the movable sleeve toward the proximal end side in the axial direction disappears. As a result, the force in the radial direction transmitted to the elastic deformation member disappears, so that the elastic deformation member returns to the original shape thereof with own elastic force.

At this moment, the transmission unit is provided for converting the force in the radial direction to return the elastic deformation member to the original shape into the force in the axial direction to return the movable sleeve moves from the proximal end side to the initial position along the axial direction, and for transmitting the force in the axial direction to the movable sleeve. Accordingly, the movable sleeve at the proximal end side in the axial direction automatically returns to the initial position.

As described above, in the first aspect of the present invention, utilizing the force in the radial direction to return the elastic deformation member thus deformed I to the original shape, it is possible to automatically return the movable sleeve moved to the distal end side or the proximal end side in the axial direction to the initial position. In other words, it is possible to automatically return the movable sleeve to the initial position with the simple configuration, in which the elastic deformation member is disposed between the movable sleeve and the connector main body.

Accordingly, as opposed to the conventional configuration, in which the coil spring is provided for automatically returning the movable sleeve to the initial position, or the movable member itself is configured to elastically deform, in the first aspect of the present invention, it is possible to reduce a dimension of the connector in the axial direction, thereby reducing a size of the connector.

Further, in the first aspect of the present invention, it is possible to automatically return the movable sleeve to the initial position with the simple configuration, in which the elastic deformation member is disposed between the movable sleeve and the connector main body. Accordingly, as opposed to the conventional configuration, it is not necessary to elastically deform the movable sleeve itself. As a result, it is possible to increase rigidity of the movable sleeve, thereby improving durability of the connector.

In order to attain the objects described above, according to a second aspect of the present invention, in the connector in the first aspect, the elastic deformation member may be formed in a C character shape. Accordingly, it is possible to produce the elastic deformation member capable of elastically deforming in the radial direction with the simple configuration or the simple part.

In order to attain the objects described above, according to a third aspect of the present invention, in the connector in the first aspect or the second aspect, the transmission unit may include a first inclined surface formed on the outer circumferential portion of the elastic deformation member, a second inclined surface formed on the outer circumferential portion of the elastic deformation member, and a sliding contact portion extending from the inner circumferential portion of the movable sleeve inwardly in the radial direction.

According to the third aspect of the present invention, the first inclined surface is inclined outwardly in the radial direction from a middle portion to a distal end portion of the elastic deformation member in the axial direction. Further, the second inclined surface is inclined outwardly in the radial direction from the middle portion to a proximal end portion of the elastic deformation member in the axial direction. Further, the sliding contact portion has an end portion arranged to slide against the first inclined surface of the elastic deformation member when the movable sleeve moves toward the distal end side from the initial position, and to slide against the second inclined surface of the elastic deformation member when the movable sleeve moves toward the proximal end side from the initial position.

According to the third aspect of the present invention, the first inclined surface and the second inclined surface are formed on the outer circumferential portion of the elastic deformation member, so that the outer circumferential portion of the elastic deformation member has a shape recessed at the middle portion in the axial direction. When the movable sleeve is situated at the initial position, the sliding contact portion of the movable sleeve is situated on the outer circumferential portion of the elastic deformation member at the middle portion thus recessed in the axial direction. In this state, the elastic deformation member, for example, does not deform at all in the radial direction, or deforms only slightly.

According to the third aspect of the present invention, when the operator holds the movable sleeve with the fingers, and applies a force to the movable sleeve to move the movable sleeve from the initial position toward the distal end side in the axial direction, the sliding contact portion of the movable sleeve is moved toward the distal end side in the axial direction while sliding against the first inclined surface of the elastic deformation member. As described above, the first inclined surface is inclined outwardly in the radial direction from the middle portion to the distal end portion of the elastic deformation member in the axial direction. Accordingly, when the sliding contact portion of the movable sleeve is moved toward the distal end side in the axial direction, the sliding contact portion pushes the first inclined surface. As a result, the elastic deformation member deforms inwardly in the radial direction.

According to the third aspect of the present invention, when the operator releases the fingers from the movable sleeve, the elastic deformation member returns to the original shape, and generates the force outwardly in the radial direction. Accordingly, the force is applied to the sliding contact portion of the movable sleeve contacting with the first inclined surface of the elastic deformation member. As described above, the first inclined surface is inclined outwardly in the radial direction from the middle portion to the distal end portion of the elastic deformation member in the axial direction. Accordingly, the sliding contact portion is pushed toward the proximal end side in the axial direction. As a result, the movable sleeve is pushed back to the initial position from the distal end side in the axial direction.

According to the third aspect of the present invention, similarly, when the operator holds the movable sleeve with the fingers, and applies a force to the movable sleeve to move the movable sleeve from the initial position toward the proximal end side in the axial direction, the sliding contact portion of the movable sleeve pushes the second inclined surface. As a result, the elastic deformation member deforms inwardly in the radial direction. When the operator releases the fingers from the movable sleeve, the elastic deformation member returns to the original shape, and generates the force outwardly in the radial direction. Accordingly, the force is applied to the sliding contact portion of the movable sleeve contacting with the second inclined surface of the elastic deformation member. Accordingly, the sliding contact portion is pushed, and the movable sleeve is pushed back to the initial position from the proximal end side in the axial direction.

In the third aspect of the present invention, as described above, after the elastic deformation member is deformed, when the elastic deformation member returns to the original shape to generate the force in the radial direction, the force in the radial direction is converted into the force in the axial direction. Then, the force in the axial direction is transmitted to the movable sleeve. Accordingly, it is possible to automatically return the movable sleeve to the initial position from the distal end side or the proximal end side in the axial direction with the simple configuration.

In order to attain the objects described above, according to a fourth aspect of the present invention, in the connector in the first aspect or the second aspect, the transmission unit may include a first inclined surface formed on the outer circumferential portion of the elastic deformation member, a second inclined surface formed on the outer circumferential portion of the elastic deformation member, a first sliding contact portion extending from the inner circumferential portion of the movable sleeve on the proximal end side inwardly in the radial direction, and a second sliding contact portion extending from the inner circumferential portion of the movable sleeve on the proximal end side inwardly in the radial direction.

According to the fourth aspect of the present invention, the first inclined surface is inclined inwardly in the radial direction from a middle portion to a distal end portion of the elastic deformation member in the axial direction. Further, the second inclined surface is inclined inwardly in the radial direction from the middle portion to a proximal end portion of the elastic deformation member in the axial direction. Further, the first sliding contact portion has an end portion arranged to slide against the second inclined surface of the elastic deformation member when the movable sleeve moves toward the distal end side from the initial position. Further, the second sliding contact portion has an end portion arranged to slide against the first inclined surface of the elastic deformation member when the movable sleeve moves toward the proximal end side from the initial position.

According to the fourth aspect of the present invention, the first inclined surface and the second inclined surface are formed on the outer circumferential portion of the elastic deformation member, so that the outer circumferential portion of the elastic deformation member has a shape protruded at the middle portion in the axial direction. When the movable sleeve is situated at the initial position, the middle portion thus protruded in the axial direction on the outer circumferential portion of the elastic deformation member is situated between the first sliding contact portion and the second sliding contact portion of the movable sleeve. In this state, the elastic deformation member, for example, does not deform at all in the radial direction, or deforms only slightly.

According to the fourth aspect of the present invention, when the operator holds the movable sleeve with the fingers, and applies a force to the movable sleeve to move the movable sleeve from the initial position toward the distal end side in the axial direction, the first sliding contact portion of the movable sleeve is moved toward the distal end side in the axial direction while sliding against the second inclined surface of the elastic deformation member. As described above, the second inclined surface is inclined inwardly in the radial direction from the middle portion to the proximal end portion of the elastic deformation member in the axial direction. Accordingly, when the first sliding contact portion of the movable sleeve is moved toward the distal end side in the axial direction, the first sliding contact portion pushes the second inclined surface. As a result, the elastic deformation member deforms inwardly in the radial direction.

According to the fourth aspect of the present invention, when the operator releases the fingers from the movable sleeve, the elastic deformation member returns to the original shape, and generates the force outwardly in the radial direction. Accordingly, the force is applied to the first sliding contact portion of the movable sleeve contacting with the second inclined surface of the elastic deformation member. As described above, the second inclined surface is inclined inwardly in the radial direction from the middle portion to the proximal end portion of the elastic deformation member in the axial direction. Accordingly, the first sliding contact portion is pushed toward the proximal end side in the axial direction. As a result, the movable sleeve is pushed back to the initial position from the distal end side in the axial direction.

According to the fourth aspect of the present invention, similarly, when the operator holds the movable sleeve with the fingers, and applies a force to the movable sleeve to move the movable sleeve from the initial position toward the proximal end side in the axial direction, the second sliding contact portion of the movable sleeve pushes the first inclined surface. As a result, the elastic deformation member deforms inwardly in the radial direction. When the operator releases the fingers from the movable sleeve, the elastic deformation member returns to the original shape, and generates the force outwardly in the radial direction. Accordingly, the force is applied to the second sliding contact portion of the movable sleeve contacting with the second inclined surface of the elastic deformation member. Accordingly, the second sliding contact portion is pushed, and the movable sleeve is pushed back to the initial position from the proximal end side in the axial direction.

In the fourth aspect of the present invention, as described above, when the elastic deformation member returns to the original shape to generate the force in the radial direction, the force in the radial direction is converted into the force in the axial direction. Then, the force in the axial direction is transmitted to the movable sleeve. Accordingly, it is possible to automatically return the movable sleeve to the initial position from the distal end side or the proximal end side in the axial direction with the simple configuration.

In order to attain the objects described above, according to a fifth aspect of the present invention, in the connector in the first aspect or the second aspect, the transmission unit may include a first inclined surface formed on the inner circumferential portion of the elastic deformation member, a second inclined surface formed on the inner circumferential portion of the elastic deformation member, and a sliding contact portion extending from the outer circumferential portion of the cylindrical member of the connector main body on the proximal end side outwardly in the radial direction.

According to the fifth aspect of the present invention, the first inclined surface is inclined inwardly in the radial direction from a middle portion to a distal end portion of the elastic deformation member in the axial direction. Further, the second inclined surface is inclined inwardly in the radial direction from the middle portion to a proximal end portion of the elastic deformation member in the axial direction. Further, the sliding contact portion has an end portion arranged to slide against the second inclined surface of the elastic deformation member when the movable sleeve moves toward the distal end side from the initial position, and to slide against the first inclined surface of the elastic deformation member when the movable sleeve moves toward the proximal end side from the initial position.

According to the fifth aspect of the present invention, when the operator holds the movable sleeve with the fingers, and applies a force to the movable sleeve to move the movable sleeve from the initial position toward the distal end side in the axial direction, the sliding contact portion of the movable sleeve pushes the second inclined surface of the elastic deformation member. As a result, the elastic deformation member deforms outwardly in the radial direction.

According to the fifth aspect of the present invention, when the operator releases the fingers from the movable sleeve, the elastic deformation member returns to the original shape, and generates the force inwardly in the radial direction. Accordingly, the force is applied to the sliding contact portion of the movable sleeve contacting with the second inclined surface of the elastic deformation member. Accordingly, the sliding contact portion is pushed toward, and the movable sleeve is pushed back to the initial position from the distal end side in the axial direction.

According to the fifth aspect of the present invention, similarly, when the operator holds the movable sleeve with the fingers, and applies a force to the movable sleeve to move the movable sleeve from the initial position toward the proximal end side in the axial direction, the sliding contact portion of the movable sleeve pushes the first inclined surface. As a result, the elastic deformation member deforms outwardly in the radial direction. When the operator releases the fingers from the movable sleeve, the elastic deformation member returns to the original shape, and generates the force inwardly in the radial direction. Accordingly, the force is applied to the sliding contact portion of the movable sleeve contacting with the second inclined surface of the elastic deformation member. Accordingly, the sliding contact portion is pushed, and the movable sleeve is pushed back to the initial position from the proximal end side in the axial direction.

In the fifth aspect of the present invention, as described above, when the elastic deformation member returns to the original shape to generate the force in the radial direction, the force in the radial direction is converted into the force in the axial direction. Then, the force in the axial direction is transmitted to the movable sleeve. Accordingly, it is possible to automatically return the movable sleeve to the initial position from the distal end side or the proximal end side in the axial direction with the simple configuration.

In order to attain the objects described above, according to a sixth aspect of the present invention, in the connector in the first aspect or the second aspect, the transmission unit may include a first inclined surface formed on the inner circumferential portion of the elastic deformation member, a second inclined surface formed on the inner circumferential portion of the elastic deformation member, a first sliding contact portion extending from the outer circumferential portion of the cylindrical member of the connector main body on the proximal end side inwardly in the radial direction, and a second sliding contact portion extending from the outer circumferential portion of the cylindrical member of the connector main body on the proximal end side inwardly in the radial direction.

According to the sixth aspect of the present invention, the first inclined surface is inclined outwardly in the radial direction from a middle portion to a distal end portion of the elastic deformation member in the axial direction. Further, the second inclined surface is inclined outwardly in the radial direction from the middle portion to a proximal end portion of the elastic deformation member in the axial direction. Further, the first sliding contact portion has an end portion arranged to slide against the first inclined surface of the elastic deformation member when the movable sleeve moves toward the distal end side from the initial position. Further, the second sliding contact portion has an end portion arranged to slide against the second inclined surface of the elastic deformation member when the movable sleeve moves toward the proximal end side from the initial position.

According to the sixth aspect of the present invention, when the operator holds the movable sleeve with the fingers, and applies a force to the movable sleeve to move the movable sleeve from the initial position toward the distal end side in the axial direction, the first sliding contact portion of the movable sleeve pushes the first inclined surface of the elastic deformation member. As a result, the elastic deformation member deforms outwardly in the radial direction.

According to the sixth aspect of the present invention, when the operator releases the fingers from the movable sleeve, the elastic deformation member returns to the original shape, and generates the force inwardly in the radial direction. Accordingly, the force is applied to the first sliding contact portion of the movable sleeve contacting with the first inclined surface of the elastic deformation member. Accordingly, the first sliding contact portion is pushed, and the movable sleeve is pushed back to the initial position from the distal end side in the axial direction.

According to the sixth aspect of the present invention, similarly, when the operator holds the movable sleeve with the fingers, and applies a force to the movable sleeve to move the movable sleeve from the initial position toward the proximal end side in the axial direction, the second sliding contact portion of the movable sleeve pushes the second inclined surface. As a result, the elastic deformation member deforms outwardly in the radial direction. When the operator releases the fingers from the movable sleeve, the elastic deformation member returns to the original shape, and generates the force inwardly in the radial direction. Accordingly, the force is applied to the second sliding contact portion of the movable sleeve contacting with the second inclined surface of the elastic deformation member. Accordingly, the second sliding contact portion is pushed, and the movable sleeve is pushed back to the initial position from the proximal end side in the axial direction.

In the sixth aspect of the present invention, as described above, when the elastic deformation member returns to the original shape to generate the force in the radial direction, the force in the radial direction is converted into the force in the axial direction. Then, the force in the axial direction is transmitted to the movable sleeve. Accordingly, it is possible to automatically return the movable sleeve to the initial position from the distal end side or the proximal end side in the axial direction with the simple configuration.

In order to attain the objects described above, according to a seventh aspect of the present invention, a pair of connectors includes a first connector and a second connector both mutually and detachably connected.

According to the seventh aspect of the present invention, the first connector includes a first cylindrical member formed in a cylindrical shape, a first supporting member disposed in the first cylindrical member, a first terminal supported on the first supporting member and extending in an axial direction, and a fitting portion formed on a distal end side of the first cylindrical member for receiving the second connector and engaging with the second connector.

According to the seventh aspect of the present invention, the fitting portion is arranged to be elastically deformable to increase a diameter thereof. Further, the fitting portion has an engaging portion on an inner circumference side thereof. When the second connector starts entering the fitting portion, the fitting portion expands in the radial direction thereof, so that the second connector is allowed to enter the fitting portion. Further, when the second connector is completely inserted into the fitting portion, the fitting portion returns to an original shape thereof, and the engaging portion engages with an engaged portion formed on the second connector.

According to the seventh aspect of the present invention, the second connector includes a connector main body including a second cylindrical member formed in a cylindrical shape, a second supporting member disposed in the second cylindrical member, a second terminal supported on the second supporting member on a proximal end side of the second cylindrical member and extending in an axial direction, and the engaged portion formed on an outer circumferential portion of the cylindrical member on a distal end side thereof.

According to the seventh aspect of the present invention, the connector further includes a movable sleeve formed in a ring shape and disposed on an outer circumference side of the connector main body to be movable along the axial direction thereof relative to the connector main body. The movable sleeve including a diameter control portion for controlling an expansion of the fitting portion of the first connector in the radial direction. When the movable sleeve is situated at an initial position, the diameter control portion moves close to or contacts with an outer circumferential portion of the fitting portion, so that the fitting portion is not capable of expanding in the radial direction. Further, when the movable sleeve moves toward the distal end side or the proximal end side from the initial position along the axial direction, the diameter control portion moves away from the outer circumferential portion of the fitting portion, so that the fitting portion is capable of expanding in the radial direction.

According to the seventh aspect of the present invention, the connector further includes an elastic deformation member formed in a substantially ring shape and disposed to be elastically deformable in a radial direction thereof; and an accommodating portion disposed between an outer circumferential portion of the connector main body on the proximal end side and an inner circumferential portion of the movable sleeve on the proximal end side for accommodating the elastic deformation member in a state that the fitting portion is capable of expanding in the radial direction.

According to the seventh aspect of the present invention, the connector further includes a transmission unit for converting a force in the axial direction generated when the movable sleeve moves toward the distal end side or the proximal end side from the initial position along the axial direction into a force in the radial direction for deforming the elastic deformation member, and for transmitting the force in the radial direction to the elastic deformation member. The transmission unit is further provided for converting the force in the radial direction to restore the elastic deformation member from the deformed state into the force in the axial direction to return the movable sleeve moves from the distal end side or the proximal end side to the initial position along the axial direction, and for transmitting the force in the axial direction to the movable sleeve.

In the seventh aspect of the present invention, the elastic deformation member is disposed between the movable sleeve and the connector main body. Accordingly, it is possible to automatically return the movable sleeve of the second connector to the initial position from the distal end side or the proximal end side in the axial direction with the simple configuration. As a result, it is possible to reduce a size of the second connector and improve the durability thereof.

As described above, in the present invention, the connector includes the lock mechanism of the push-pull type, and it is possible to reduce the size of the connector through decreasing the dimension in the axial direction. Further, it is possible to increase the rigidity of the movable sleeve. Accordingly, it is possible to prevent deformation or damage due to twisting and the like, thereby making it possible to improve the durability of the connector.

DETAILED DESCRIPTION OF THE PREFERRED EMBODIMENTS

Hereunder, an electrical connector according to an embodiment of the present invention will be explained with reference to the accompanying drawings.

First Embodiment

Figure 1:
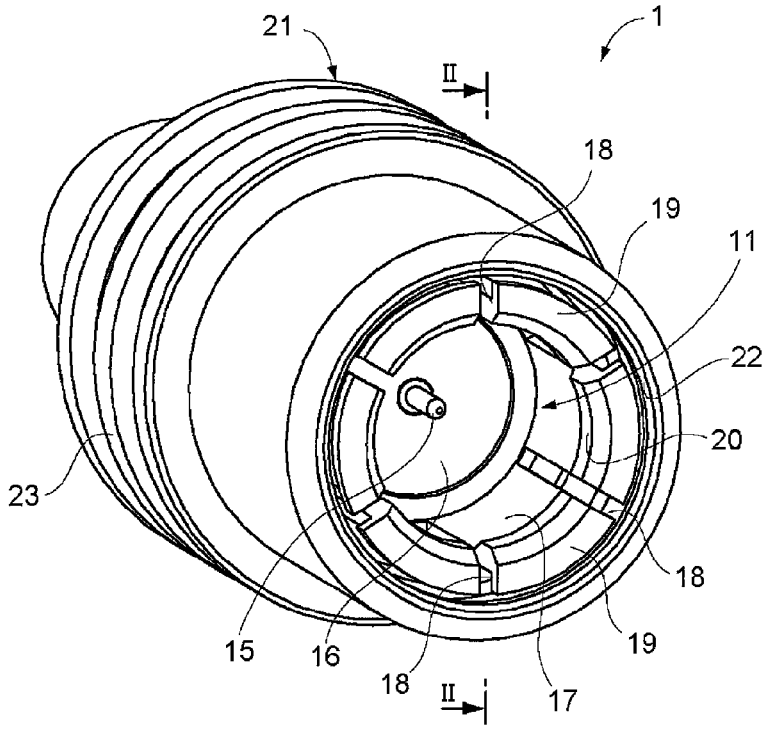
FIG. 1 is a perspective view showing an electrical connector according to a first embodiment of the present invention.
Figure 2:
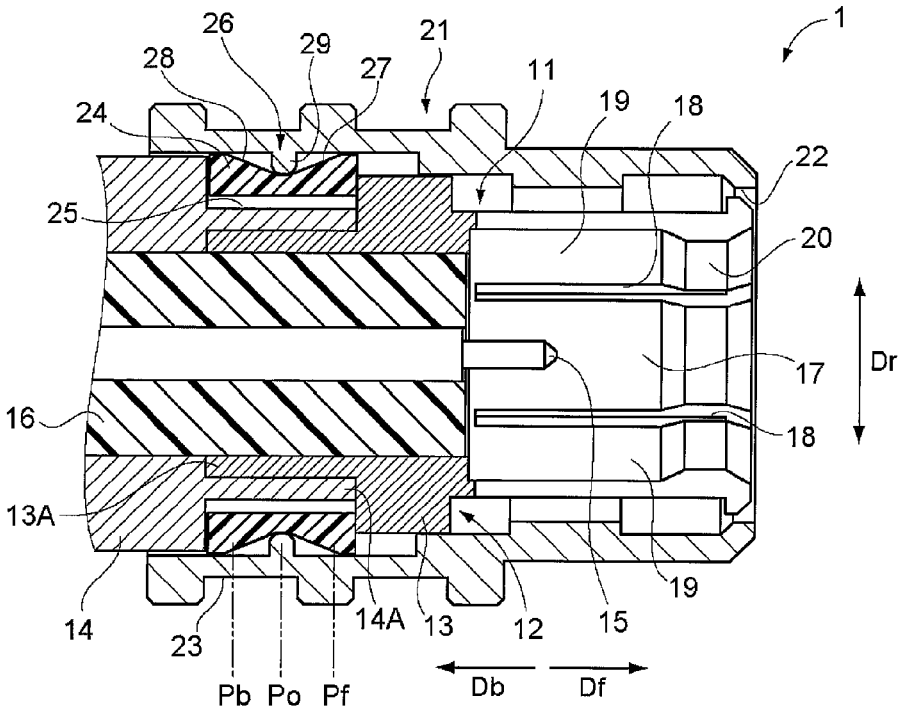
FIG. 2 is a sectional view showing the electrical connector according to the first embodiment of the present invention, taken along a line II-II in FIG. 1.
Figure 3:
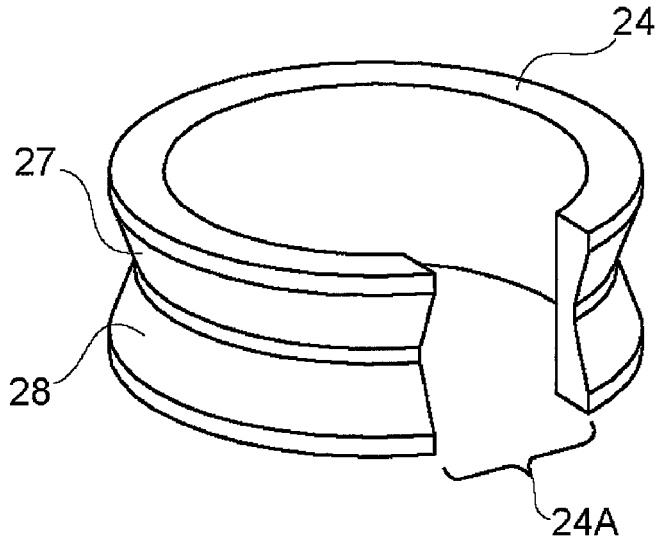
FIG. 3 is a perspective view showing an elastic deformation member of the electrical connector according to the first embodiment of the present invention.

A first embodiment of the present invention will be explained. FIGS. 1 and 2 show an electrical connector according to a first embodiment of the present invention. FIG. 3 shows an elastic deformation member provided to the electrical connector. FIG. 3 shows measurements of various portions in the electrical connector at a proximal end portion thereof.

As shown in FIG. 1, the electrical connector 1 according to the first embodiment of the present invention is a coaxial connector equipped with a locking mechanism of push-pull style. The electrical connector 1 is configured substantially with a connector main body 11 and a movable sleeve 21 being movable in a direction of an axis, provided around an outer circumference of the connector main body 11.

As shown in FIG. 2, the connector main body 11 includes a cylindrical member 12. The cylindrical member 12 forms an outer shell of the connector main body 11. In addition, the cylindrical member 12 functions as an external terminal contacting electrically with an external conductive member of a coaxial cable (not shown) connected to another end of the electrical connector 1. The cylindrical member 12 is configured with a cylindrical portion 13 and a cylindrical portion 14 connected to each other.

In the embodiment, the cylindrical portion 13 and the cylindrical portion 14 have cylindrical shapes and are made from a metallic material, respectively. In other words, the cylindrical member 12 is configured by pushing a connecting portion 13A at a proximal end of the cylindrical portion 13 and a connecting portion 14A at a distal end of the cylindrical portion 14 into each other when the electrical connector 1 is manufactured.

A central terminal 15 is provided at the proximal end portion of inside the cylindrical member 12. The central terminal 15 contacts with a central conductive member of the coaxial cable described above. The central terminal 15 is fixed in a position of a central axis of the cylindrical member 12 with a supporting member 16. The supporting member 16 is made from an insulating material such as a resin. A tip portion of the central terminal 15 protrudes into a fitting portion 17, which will be described later.

In the embodiment, the cylindrical member 12 includes the fitting portion 17 at a distal end portion thereof. The fitting portion 17 receives a mating connector 2 (refer to FIG. 5) in order to connect to the mating connector 2. The fitting portion 17 has a space inside thereof for receiving a distal end portion of the mating connector 2. Further, the fitting portion 17 has an opening at the distal end of the electrical connector 1. The fitting portion 17 has a shape of collet chucks. That is, the distal end portion of the fitting portion 17 is divided into a plurality of segments 19 by a dividing groove 18 formed in the distal end portion of the fitting portion 17 at a plurality of positions in a circumferential direction. Accordingly, the fitting portion 17 is capable of expanding a diameter thereof elastically in a direction of an arrow Dr shown in FIG. 2.

In the embodiment, the fitting portion 17 includes an engaging portion 20 in an inner circumferential portion thereof. The engaging portion 20 protrudes at the distal end portion of the fitting portion 17 toward inside in a direction of the diameter thereof. The engaging portion 20 engages an engaged portion 36 of the mating connector 2 when the mating connector 2 is connected to the fitting portion 17.

The movable sleeve 21 is formed in a cylindrical shape and made from, for example, a metallic material, a resin material and the like. The movable sleeve 21 is attached to the connector main body 11 so as to surround the outer circumference of the connector main body 11 from the proximal end of the connector main body 11 to the distal end of the fitting portion 17. Further, the movable sleeve 21 is movable against the connector main body 11 in the direction of the axis, in other words, in directions of arrows Db and Df shown in FIG. 2.

In addition, the movable sleeve 21 includes a diameter control portion 22 in a distal end portion of the inner circumference thereof. The diameter control portion 22 prevents the fitting portion 17 from expanding the diameter thereof as the movable sleeve 21 is situated in an initial position, while enabling the fitting portion 17 to expand the diameter thereof as the movable sleeve 21 is moved in a direction of the proximal end or in a direction of the distal end from the initial position.

In the embodiment, the diameter control portion 22 protrudes from the distal end portion of the movable sleeve 21 inwardly in the direction of the diameter thereof. When the movable sleeve 21 is in the initial position, an end portion of an inner circumferential surface of the diameter control portion 22 is situated close to an outer circumferential surface of the distal end portion of the fitting portion 17.

More specifically, when the movable sleeve 21 is in the initial position, the end portion of the inner circumferential surface of the diameter control portion 22 faces the outer circumferential surface of the distal end portion of the fitting portion 17 with a narrow space in between, as well as surrounding the entire outer circumferential surface of the distal end portion of the fitting portion 17. Therefore, the fitting portion 17 is not allowed to expand the diameter thereof since the outer circumferential surface of the distal end portion of the fitting portion 17 abuts against the end portion of the inner circumferential surface of the diameter control portion 22.

When the movable sleeve 21 is in the initial position, the end portion of the inner circumferential surface of the diameter control portion 22 may contact with the outer circumferential surface of the distal end portion of the fitting portion 17 so as to be moved slidingly.

When the movable sleeve 21 is moved from the initial position to the distal end in the direction of the axis, the diameter control portion 22 is moved from the distal end portion of the fitting portion 17 in the direction of the arrow Df, being apart from the distal end portion of the fitting portion 17. Therefore, a relatively larger space is generated between the distal end portion of the inner circumferential surface of the diameter control portion 22 and the outer circumferential surface of the distal end portion of the fitting portion 17. Thereby, the fitting portion 17 is allowed to expand the diameter thereof.

In addition, when the movable sleeve 21 is moved from the initial position to the proximal end in the direction of the axis, the diameter control portion 22 is moved in the direction of the arrow Db from the distal end portion of the fitting portion 17, being apart from the distal end portion of the fitting portion 17. In this case, the distal end portion of the fitting portion 17 protrudes from the movable sleeve 21, thereby the fitting portion 17 is allowed to expand the diameter thereof.

In the embodiment, the movable sleeve 21 further includes a holding portion 23 at an outer circumferential surface of a proximal end portion thereof. When an operator moves the movable sleeve 21, the operator holds the holding portion 23 of the movable sleeve 21 with fingers. The holding portion 23 has an uneven surface in order to prevent the fingers from slipping.

Furthermore, the electrical connector 1 includes the elastic deformation member 24, an accommodating portion 25 and a transmission unit 26 as a mechanism so that the movable sleeve 21 moved in the direction of the axis is able to return to the initial position automatically. The accommodating portion 25 accommodates the elastic deformation member 24 and the transmission unit 26 generates force bringing back the movable sleeve 21 to the initial position by utilizing elastic force of the elastic deformation member 24.

As shown in FIG. 2, the elastic deformation member 24 is situated between the connector main body 11 and the movable sleeve 21 at the proximal end portion of the connector main body 11. As shown in FIG. 3, the elastic deformation member 24 is made from a resin material and has a substantial ring shape, namely, has a C-letter shape as a whole with a separation space 24A. The elastic deformation member 24 is capable of being deformed with elasticity thereof in a direction of a diameter thereof.

In other words, the elastic deformation member 24 is deformed so as to shrink the diameter thereof by changing a width the separation space 24A as the elastic deformation member 24 receives an external force toward inside in the direction of the diameter from an outer circumference thereof. When it stops applying the external force after the elastic deformation member 24 is deformed, the elastic deformation member 24 restores the shape as shown in FIG. 3, expanding the diameter thereof by the elasticity thereof.

In the embodiment, the accommodating portion 25, as shown in FIG. 2, is situated between the outer circumference in the proximal end portion of the connector main body 11 and an inner circumference in the proximal end portion of the movable sleeve 21. More specifically, the accommodating portion 25 has a groove shape stretching in the circumferential direction around the outer circumferential surface in the proximal end portion of the cylindrical member 12 of the connector main body 11.

In the embodiment, the accommodating portion 25 accommodates the elastic deformation member 24 therein so that the elastic deformation member 24 is able to be deformed inwardly in the direction of the diameter. The accommodating portion 25 has a dimension in the direction of the diameter (a groove depth) designed so that the elastic deformation member 24 is able to be deformed inwardly in the direction of the diameter by a certain amount. The dimension of the accommodating portion 25 in the direction of the diameter will be described later. Further, the accommodating portion 25 has a dimension in the direction of the axis designed so that the elastic deformation member 24 does not move in the direction of the axis while being deformed smoothly in the direction of the diameter. More specifically, the accommodating portion 25 has the dimension in the direction of the axis slightly larger than a dimension of the elastic deformation member 24 in the direction of the axis.

In the embodiment, the transmission unit 26 converts a force in the direction of the axis generated by moving the movable sleeve 21 from the initial position in a direction of the proximal end or in a direction of the distal end into a force in the direction of the diameter. Further, the transmission unit 26 transmits the force in the direction of the diameter thus converted to the elastic deformation member 24 for deforming the elastic deformation member 24.

Additionally, the transmission unit 26 converts a force in the direction of the diameter generated when the elastic deformation member 24 thus deformed restores the shape thereof into a force in the direction of the axis. Further, the transmission unit 26 transmits the force in the direction of the axis thus converted to the movable sleeve 21 for bringing back the movable sleeve 21 from the proximal end or the distal end to the initial position. The transmission unit 26 includes at least two inclined surfaces 27, 28 formed on an outer circumferential surface of the elastic deformation member 24 and a sliding contact portion 29 provided in the movable sleeve 21.

As shown in FIG. 2, the inclined surface 27 inclines by a predetermined angle toward outside in the direction of the diameter, from a middle portion to the distal end of the elastic deformation member 24 in the direction of the axis. Further, the inclined surface 27 extends around the entire outer circumferential surface of the elastic deformation member 24.

In the embodiment, the inclined surface 28 inclines by a predetermined angle toward outside in the direction of the diameter, from the middle portion to the proximal end of the elastic deformation member 24 in the direction of the axis. The inclined surface 28 extends around the entire outer circumferential surface of the elastic deformation member 24. With the inclined surfaces 27 and 28, the elastic deformation member 24 has a shape constricted at the middle portion thereof in the direction of the axis.

In the embodiment, the sliding contact portion 29 protrudes from the inner circumference at a proximal end side of the movable sleeve 21 toward inside in the direction of the diameter. When the movable sleeve 21 is in the initial position, the sliding contact portion 29 is situated in a neutral position Po as shown in FIG. 2. When the sliding contact portion 29 is in the neutral position Po, an end portion of the sliding contact portion 29 is close to or contacts with the middle portion of the elastic deformation member 24 where the inclined surfaces 27 and 28 contacts with each other. At this point, the elastic deformation member 24 is not deformed or is slightly deformed in the direction of the diameter inwardly due to the contact of the sliding contact portion 29 and the like.

When the movable sleeve 21 is moved from the initial position in a direction of the distal end, the sliding contact portion 29 is moved from the neutral position Po to a pressing position Pf. The end portion of the sliding contact portion 29 contacts slidingly with the inclined surface 27 of the elastic deformation member 24 as the sliding contact portion 29 is moved from the neutral position Po to the pressing position Pf. Thereby, the sliding contact portion 29 presses the inclined surface 27 of the elastic deformation member 24. As a result, the elastic deformation member 24 is considerably deformed inwardly in the direction of the diameter.

When the movable sleeve 21 is moved from the initial position in a direction of the proximal end, the sliding contact portion 29 is moved from the neutral position Po to a pressing position Pb. The end portion of the sliding contact portion 29 contacts slidingly with the inclined surface 28 of the elastic deformation member 24 as the sliding contact portion 29 is moved from the neutral position Po to the pressing position Pb. Thereby, the sliding contact portion 29 presses the inclined surface 28 of the elastic deformation member 24. As a result, the elastic deformation member 24 is considerably deformed inwardly in the direction of the diameter.

In the embodiment, the sliding contact portion 29 may extend around the entire inner circumference of the movable sleeve 21 as an elongated protrusion. The sliding contact portion 29 also may be divided into a plurality of protruding pieces arranged in the inner circumference of the movable sleeve 21 with a constant or inconstant interval in the circumferential direction.

Figure 4:
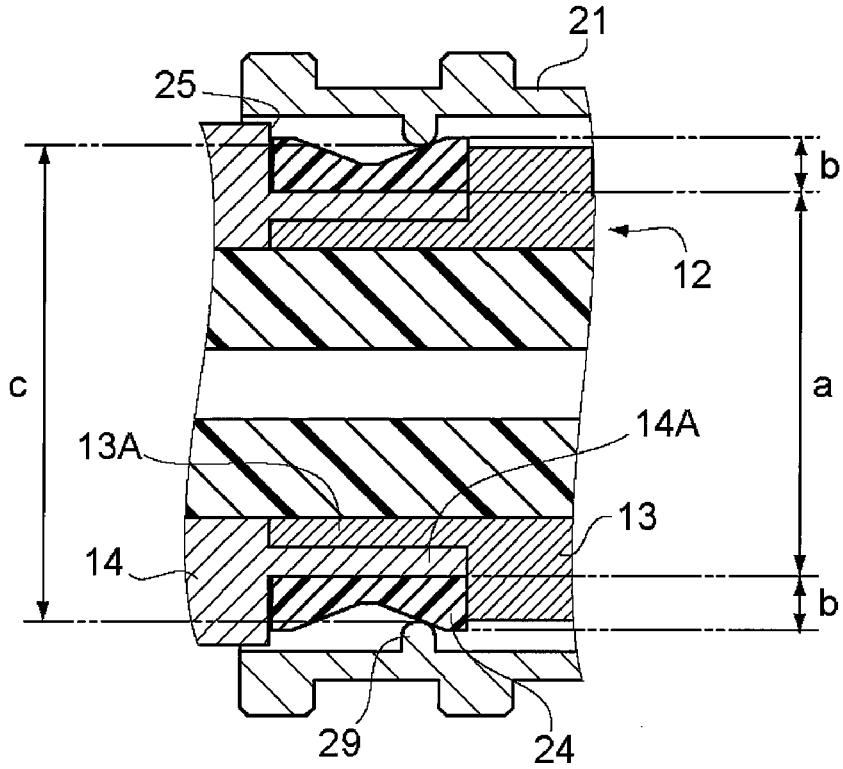
FIG. 4 is a view showing measurements of various portions in the electrical connector at a proximal end portion thereof, according to the first embodiment of the present invention.

Hereunder, relation about measurements of various portions in the electrical connector 1 at a proximal end portion thereof will be explained. As shown in FIG. 4, when an inner diameter of the cylindrical member 12 where the accommodating portion 25 is situated is a; a thickness of the elastic deformation member 24 at the distal end portion or at the proximal end portion in the direction of the axis is b; and an inner diameter of the movable sleeve 21 where the sliding contact portion 29 is situated is c, relation among a, b and c satisfies a following expression (1):

$$c<a+2b \quad (1)$$

According to the expression (1) above, the movable sleeve 21 is controlled movement thereof in the direction of the axis, so that the diameter control portion 22 is able to admit or stop expanding the diameter of the fitting portion 17 appropriately. Consequently, it is possible to prevent the movable sleeve 21 from coming off the connector main body 11 due to the movement in the direction of the axis of the movable sleeve 21 beyond the control described above.

Therefore, as shown in FIG. 4, when the relation among a, b and c satisfies the expression (1), the sliding contact portion 29 is pressed against the inclined surface 27 of the elastic deformation member 24 as the movable sleeve 21 moves in the direction of the distal end from the initial position. Accordingly, the elastic deformation member 24 is considerably deformed inwardly in the direction of the diameter.

When an inner circumferential surface of the elastic deformation member 24 thus deformed contacts with a bottom surface of the groove shape of the accommodating portion 25, the sliding contact portion 29 abuts against the distal end of the inclined surface 27 of the elastic deformation member 24. As a result, the movable sleeve 21 is not allowed to move further in the direction of the distal end. Similarly, when the movable sleeve 21 moves in the direction of the proximal end from the initial position, the sliding contact portion 29 is pressed against the inclined surface 28 of the elastic deformation member 24.

When the inner circumferential surface of the elastic deformation member 24 thus deformed contacts with the bottom surface of the groove shape of the accommodating portion 25, the sliding contact portion 29 abuts against the proximal end of the inclined surface 28 of the elastic deformation member 24. As a result, the movable sleeve 21 is not allowed to move further in the direction of the proximal end.

The electrical connector 1 configured as described above is manufactured as described below. First, as shown in FIG. 2, the central terminal 15 is attached to the cylindrical portion 13 with the supporting member 16. Then the cylindrical portion 13 is inserted into the movable sleeve 21 from the proximal end of the movable sleeve 21. At this time, the connecting portion 13A of the cylindrical portion 13 is arranged so as to correspond to the sliding contact portion 29. Next, the elastic deformation member 24 is inserted into the movable sleeve 21 from the proximal end of the movable sleeve 21 as being deformed inwardly in the direction of the axis.

In the embodiment, the elastic deformation member 24 is placed between the inner circumference of the movable sleeve 21 and an outer circumference of the connecting portion 13A of the cylindrical portion 13. Accordingly, the middle portion of the elastic deformation member 24 is situated at a corresponding position to the sliding contact portion 29. Further, a distal end portion of the connecting portion 14A of the cylindrical portion 14 is inserted into the movable sleeve 21 from the proximal end of the movable sleeve 21.

At this time, the connecting portion 14A is arranged so that the distal end portion of the connecting portion 14A is situated into a space formed between the connecting portion 13A of the cylindrical portion 13 and the elastic deformation member 24. Then the connecting portion 14 thus arranged is inserted into the movable sleeve 21. Thereby, the electrical connector 1 is assembled completely.

As described above, the cylindrical member 12 includes the cylindrical portion 13 and the cylindrical portion 14. The cylindrical portion 13 provides a sidewall on a distal end side of the accommodating portion 25 and the cylindrical portion 14 provides a sidewall on the proximal end side of the accommodating portion 25. The cylindrical portions 13 and 14 are connected to each other upon manufacturing the electrical connector 1. Consequently, it is possible to easily manufacture the electrical connector 1 with the elastic deformation member 24 irremovable from the accommodating portion 25.

Figure 5:
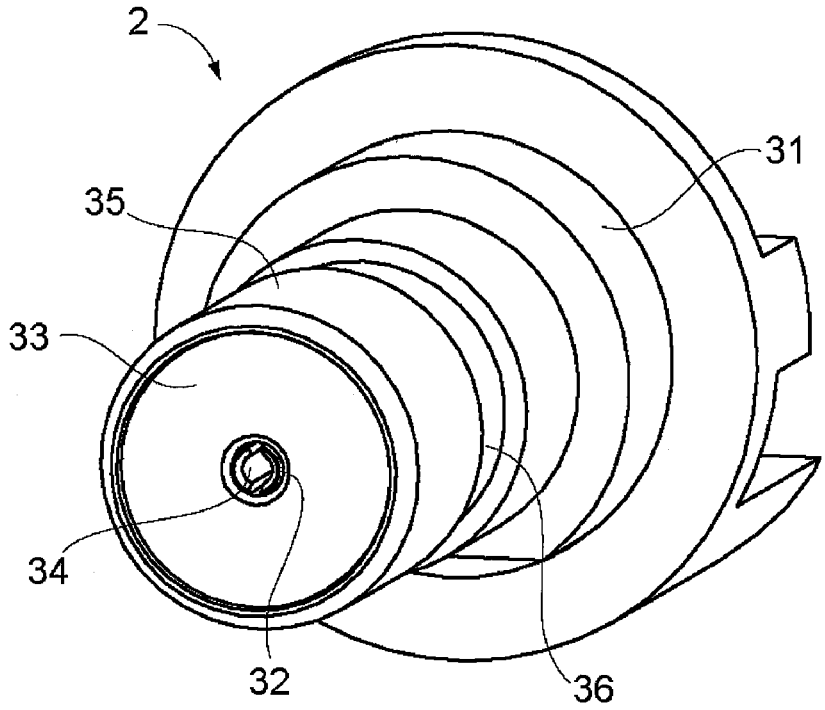
FIG. 5 is a perspective view showing a mating connector according to the first embodiment of the present invention.
Figure 6:
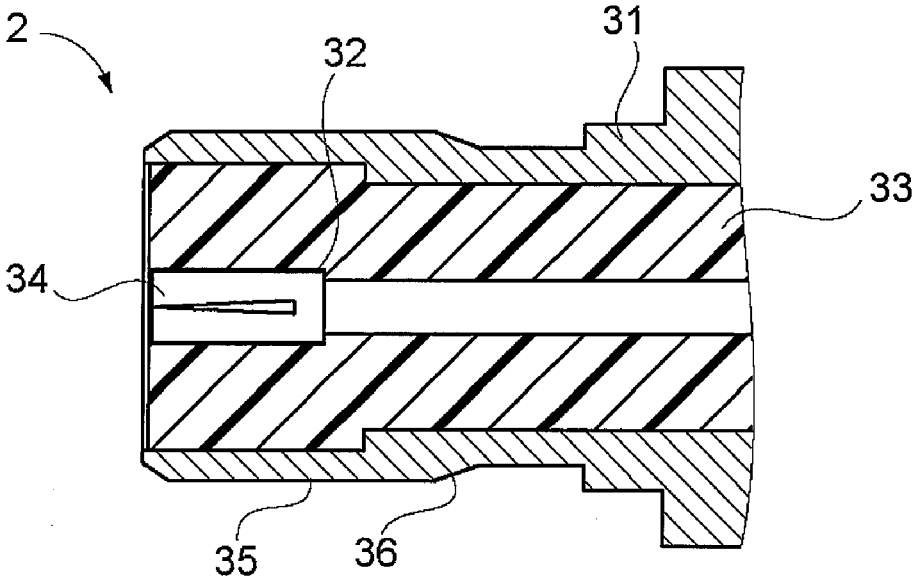
FIG. 6 is a sectional view showing the mating connector according to the first embodiment of the present invention.

FIGS. 5 and 6 show the mating connector 2 to be connected to the electrical connector 1. As shown in FIGS. 5 and 6, the mating connector 2 includes an outer cylindrical member 31. The outer cylindrical member 31 forms an outer shell of the mating connector 2. In addition, the outer cylindrical member 31 functions as an external terminal. The outer cylindrical member 13 is made from a metallic material and has a tiered cylindrical shape. Other end of the mating connector 2 is directly attached to, for example, a housing of a device, a circuit board and so on (not shown). The outer cylindrical member contacts electrically, for example, with a ground of the device, the circuit board and so on.

In the embodiment, the mating connector 2 includes a mating terminal 32 inside the outer cylindrical member 31 thereof. The mating terminal 32 contacts electrically, for example, with a signal line of the device, the circuit board and so on. The mating terminal 32 is fixed in a position of a central axis of the outer cylindrical member 31 with a supporting member 33. The supporting member 33 is made from an insulating material such as a resin. The mating terminal 32 includes a contact hole 34 at a tip portion thereof. The tip portion of the central terminal 15 of the electrical connector 1 enters the contact hole 34.

In the embodiment, the outer cylindrical member 31 includes an insertion portion 35 at a distal end portion thereof. The insertion portion 35 is inserted and fitted into the fitting portion 17 of the electrical connector 1. The mating connector 2 further includes the engaged portion 36. The engaged portion 36 is situated at a position being apart from a distal end of the insertion portion 35 by a predetermined distance in a direction of a proximal end portion. The engaged portion 36 is a depression surrounding an entire outer circumference of the insertion portion 35. A shape of the depression corresponds to a shape of the engaging portion 20 provided on the inner circumference of the fitting portion 17.

When the insertion portion 35 of the mating connector 2 is inserted into the fitting portion 17 of the electrical connector 1 as the movable sleeve 21 of the electrical connector 1 is moved in the direction of the distal end from the initial position, an outer circumference surface of the insertion portion 35 contacts slidingly with an end surface of the engaging portion 20 of the electrical connector 1.

Further, the fitting portion 17 expands the diameter thereof when the insertion portion 35 of the mating connector 2 is inserted into the fitting portion 17 of the electrical connector 1 further. Furthermore, when the insertion portion 35 of the mating connector 2 reaches inside of the fitting portion 17 of the electrical connector 1, the engaging portion 20 of the electrical connector 1 enters the engaged portion 36 of the mating connector 2. Thereby the engaging portion 20 and the engaged portion 36 engage each other.

FIGS. 7(A) to 7(D) show a process of connecting the electrical connector 1 to the mating connector 2. FIGS. 8(A) and 8(B) show a process of extracting the electrical connector 1 from the mating connector 2.

Figure 7A:
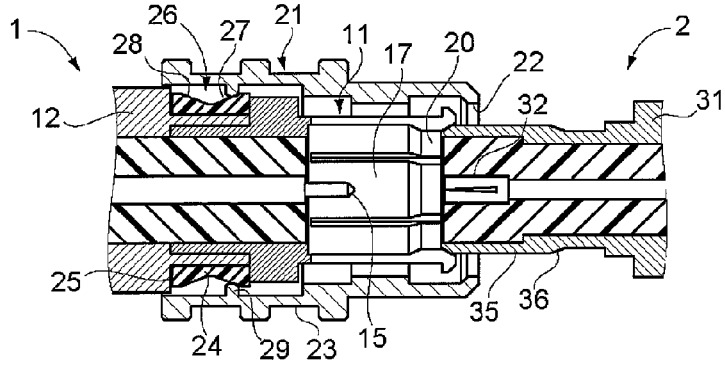
FIGS. 7(A) to 7(D) are sectional views showing a process of connecting the electrical connector to the mating connector, according to the first embodiment of the present invention.
Figure 8A:
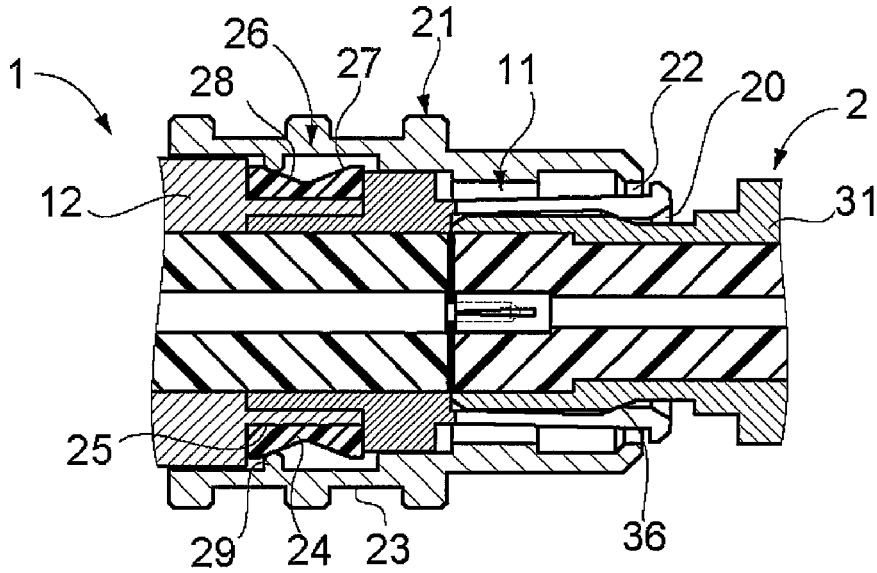
FIGS. 8(A) and 8(B) are sectional views showing a process of extracting the electrical connector from the mating connector, according to the first embodiment of the present invention.
Figure 8B:
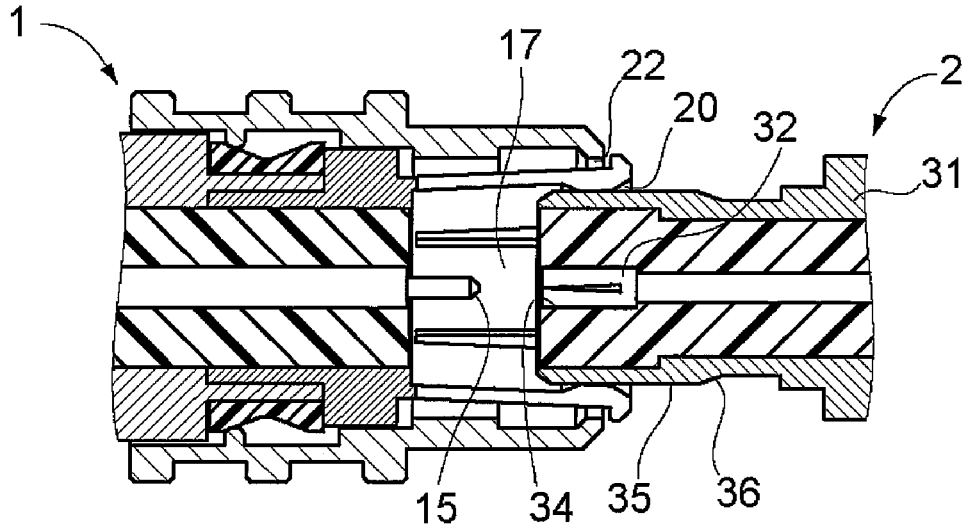

As shown in FIG. 7(A), when the electrical connector 1 is connected to the mating connector 2, the operator holds the holding portion 23 of the movable sleeve 21 with the fingers. Then, the operator applies force so that the electrical connector 1 is pushed toward the mating connector 2 as the distal end portion of the fitting portion 17 of the electrical connector 1 and the distal end portion of the insertion portion 35 of the mating connector 2 contact with each other.

With the force described above, the movable sleeve 21 of the electrical connector 1 is moved in the direction of the distal end from the initial position. When the movable sleeve 21 of the electrical connector 1 is moved in the direction of the distal end from the initial position, the diameter control portion 22 is moved being apart from the outer circumferential surface of the distal end portion of the fitting portion 17.

Therefore, the fitting portion 17 is allowed to expand the diameter thereof. In addition, as the movable sleeve 21 is moved as described above, the sliding contact portion 29 is moved from the neutral position Po to the pressing position Pf (refer to FIG. 2). Therefore, the end portion of the sliding contact portion 29 contacts slidingly with the inclined surface 27 of the elastic deformation member 24. Thereby, the sliding contact portion 29 is pressed against the inclined surface 27. As a result, the elastic deformation portion 24 is deformed inwardly in the direction of the diameter.

Figure 7B:
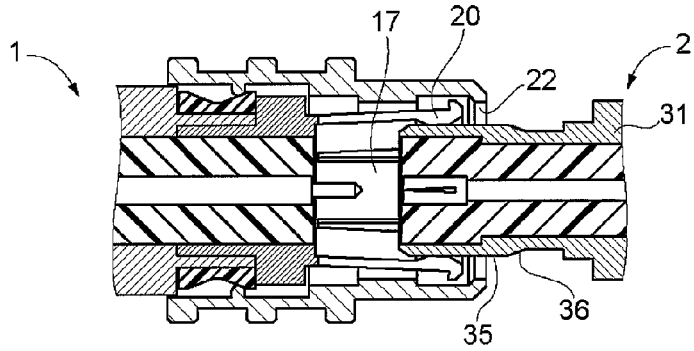

Next, as shown in FIG. 7(B), when the operator pushes the electrical connector 1 toward the mating connector 2 further, the insertion portion 35 of the mating connector 2 enters the fitting portion 17 of the electrical connector 1. As the insertion portion 35 of the mating connector 2 enters the fitting portion 17 of the electrical connector 1 further, the fitting portion 17 expands the diameter thereof.

Figure 7C:
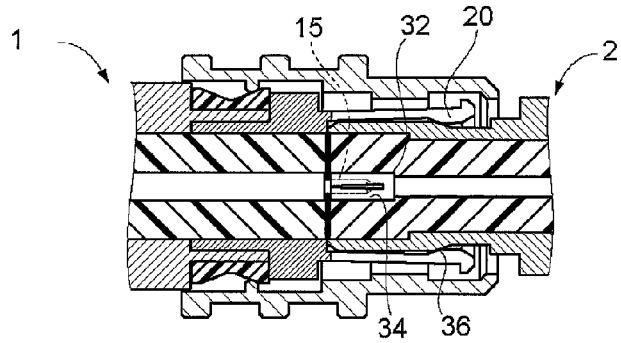

As shown in FIG. 7(C), when the insertion portion 35 of the mating connector 2 reaches inside of the fitting portion 17 of the electrical connector 1, the central terminal 15 of the electrical connector 1 fits into the contact hole 34 of the mating terminal 32 of the mating connector 2. Additionally, the engaging portion 20 engages the engaged portion 36. The operator recognizes the electrical connector 1 is connected to the mating connector 2 certainly, with sound and vibration generated as the engaging portion 20 engages the engaged portion 36.

Figure 7D:
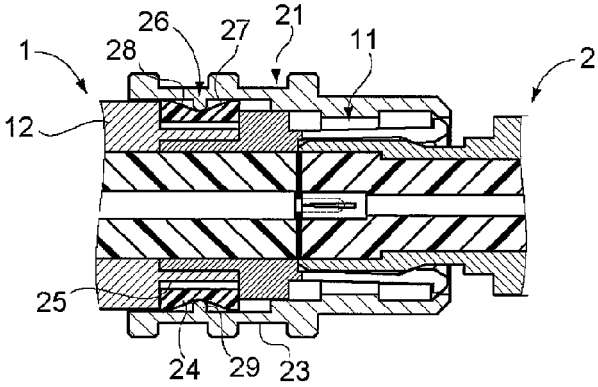

Next, as shown in FIG. 7(D), as the fingers of the operator are taken off from the holding portion 23 of the movable sleeve 21, the force moving the movable sleeve 21 toward the distal end from the initial position disappears. Accordingly, the force deforming the elastic deformation member 24 inwardly in the direction of the diameter also disappears. Therefore, the elastic deformation member 24 restores the shape thereof to an initial shape with the elasticity thereof.

For this reason, a force restoring the shape of the elastic deformation member 24 is applied to the sliding contact portion 29 of the movable sleeve 21 toward outside in the direction of the diameter, since the sliding contact portion 29 abuts against the inclined surface 27 of the elastic deformation member 24. Therefore, the sliding contact portion 29 is pushed toward the proximal end in the direction of the axis. Consequently, the movable sleeve 21 thus pushed to the distal end side returns to the initial position thereof as the sliding contact portion 29 returns from the pressing position Pf to the neutral position Po (refer to FIG. 2).

When the movable sleeve 21 returns to the initial position, the diameter control portion 22 comes closer to the outer circumferential surface of the distal end portion of the fitting portion 17. Thereby, the fitting portion 17 is not allowed to expand the diameter thereof. Accordingly, the engaging portion 20 of the electrical connector 1 is fixed in a state of engaging the engaged portion 36 of the mating connector 2. As a result, the electrical connector 1 and the mating connector 2 are locked as connecting to each other.

Next, as shown in FIG. 8(A), when the electrical connector 1 is extracted from the mating connector 2, the operator holds the holding portion 23 of the movable sleeve 21 with the fingers and applies force so that the electrical connector 1 is pulled so as to be apart from the mating connector 2.

With the force described above, the movable sleeve 21 of the electrical connector 1 is moved in the direction of the proximal end from the initial position. When the movable sleeve 21 of the electrical connector 1 is moved in the direction of the proximal end from the initial position, the diameter control portion 22 is moved so as to be apart from the distal end portion of the fitting portion 17. Thereby, the electrical connector 1 and the mating connector 2 are unlocked since the fitting portion 17 is allowed to expand the diameter thereof.

Further, as the movable sleeve 21 is moved as described above, the sliding contact portion 29 is moved from the neutral position Po to the pressing position Pb (refer to FIG. 2). Therefore, the end portion of the sliding contact portion 29 contacts slidingly with the inclined surface 28 of the elastic deformation member 24. Thereby, the sliding contact portion 29 is pressed against the inclined surface 28 of the elastic deformation member 24. As a result, the elastic deformation portion 24 is deformed inwardly in the direction of the diameter.

Next, as shown in FIG. 8(B), when the operator pulls the electrical connector 1 so as to be apart from the mating connector 2 further, the engaging portion 20 of the electrical connector 1 expands the diameter of the fitting portion 17, being removed from the engaged portion 36 of the mating connector 2. As a result, the central terminal 15 of the electrical connector 1 comes off the contact hole 34 of the mating terminal 32 of the mating connector 2. Further, the insertion portion 35 of the mating connector 2 is pulled out of the fitting portion 17 of the electrical connector 1. Thereby, the electrical connector 1 is extracted from the mating connector 2.

When the electrical connector 1 is extracted from the mating connector 2, the force moving the movable sleeve 21 toward the proximal end disappears. Accordingly, the force deforming the elastic deformation member 24 inwardly in the direction of the diameter also disappears. Therefore, the elastic deformation member 24 restores the shape thereof to the initial shape with the elasticity thereof.

For this reason, a force restoring the shape of the elastic deformation member 24 is applied to the sliding contact portion 29 of the movable sleeve 21 toward outside in the direction of the diameter, since the sliding contact portion 29 abuts against the inclined surface 28 of the elastic deformation member 24. Therefore, the sliding contact portion 29 is pushed toward the distal end in the direction of the axis. Consequently, the movable sleeve 21 thus pushed to the proximal end side returns to the initial position thereof as the sliding contact portion 29 returns from the pressing position Pb to the neutral position Po (refer to FIG. 2).

As described above, according to the first embodiment of the present invention, the electrical connector 1 enables to obtain a function which automatically returns the movable sleeve 21 to the initial position with a simple configuration such that arranging the elastic deformation member 24 between the movable sleeve 21 and the connector main body 11. Consequently, as compared to the case that having a coiled spring or having the movable sleeve capable of elastic deformation as a mechanism for returning automatically the movable sleeve to the initial position, the electrical connector 1 is able to have lesser dimension in the direction of the axis. As a result, it enables the electrical connector 1 to be downsized.

In addition, according to the first embodiment of the present invention, the electrical connector 1 enables to increase rigidity of the movable sleeve 21 thereof, since it is not necessary to deform the movable sleeve 21 elastically. Accordingly, it is possible to prevent the movable sleeve 21 from deformation or being damaged due to being twisted forcibly and the like. Consequently, the electrical connector 1 is able to obtain higher durability.

Second Embodiment

Figure 9:
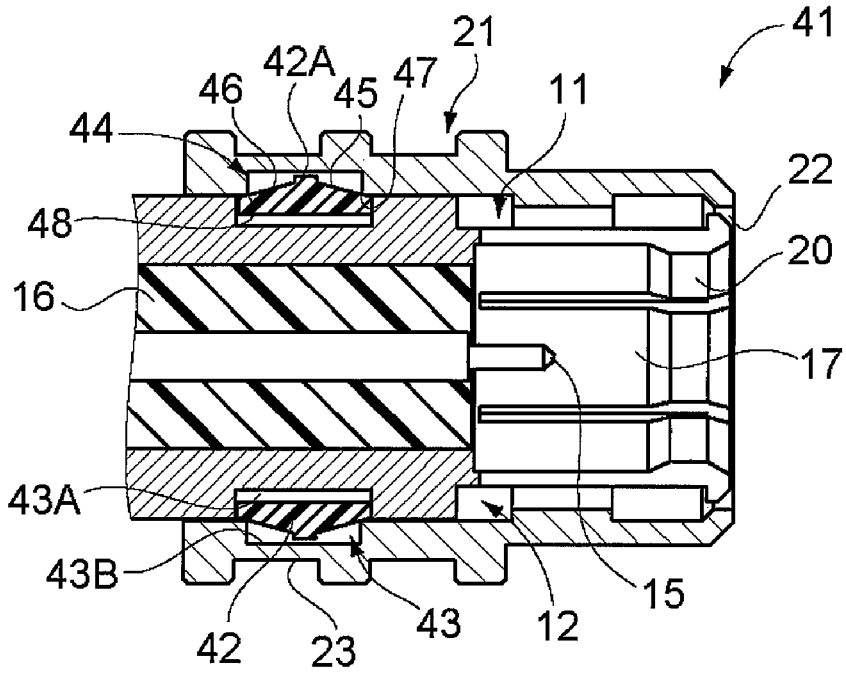
FIG. 9 is a sectional view showing an electrical connector according to a second embodiment of the present invention.

A second embodiment of the present invention will be explained next. FIG. 9 is a sectional view showing an electrical connector according to a second embodiment of the present invention. In FIG. 9, components unchanged from the first embodiment have the same numeral references as FIGS. 1 to 8(B) and explanations thereof will be omitted.

As shown in FIG. 9, the electrical connector 41 according to the second embodiment of the present invention includes an elastic deformation member 42; an accommodating portion 43 and a transmission unit 44 as the mechanism for returning the movable sleeve 21 moved by the operator in the direction of the axis to the initial position automatically. The accommodating portion 43 accommodates the elastic deformation member 42 and the transmission unit 44 generates force bringing back the movable sleeve 21 to the initial position by utilizing elastic force of the elastic deformation member 42.

The elastic deformation member 42 is made from a resin material and has a C-letter shape as a whole. The elastic deformation member 42 is capable of being deformed with elasticity thereof in a direction of a diameter thereof. These aspects are the same as aspects of the elastic deformation member 24 in the first embodiment.

The accommodating portion 43 is situated between the outer circumference in the proximal end portion of the connector main body 11 and the inner circumference in the proximal end portion of the movable sleeve 21. The accommodating portion 43 includes grooves 43A and 43B. The groove 43A stretches in the circumferential direction around the outer circumferential surface in the proximal end portion of the cylindrical member 12 of the connector main body 11.

In the embodiment, the groove 43B stretches in the circumferential direction around an inner circumferential surface in the proximal end portion of the movable sleeve 21 so as to face the groove 43A. The accommodating portion 43 accommodates the elastic deformation member 42 therein so that the elastic deformation member 42 is able to be deformed toward inside in the direction of the diameter while being disabled to be moved in the direction of the axis.

In the embodiment, the transmission unit 44 converts the force in the direction of the axis generated by moving the movable sleeve 21 from the initial position in the direction of the proximal end or in the direction of the distal end into the force in the direction of the diameter. Further, the transmission unit 44 transmits the force in the direction of the diameter thus converted to the elastic deformation member 42 for deforming the elastic deformation member 42.

Additionally, the transmission unit 44 converts the force in the direction of the diameter generated when the elastic deformation member 42 thus deformed restores the shape thereof into the force in the direction of the axis. Further, the transmission unit 44 transmits the force in the direction of the axis thus converted to the movable sleeve 21 for bringing back the movable sleeve 21 from the proximal end or the distal end to the initial position. The transmission unit 44 includes at least two inclined surfaces 45 and 46 formed on the outer circumferential surface of the elastic deformation member 42 and two sliding contact portions 47 and 48 provided in the movable sleeve 21.

In the embodiment, the inclined surface 45 inclines by a predetermined angle toward inside in the direction of the diameter, from the middle portion to the distal end portion of the elastic deformation member 42 in the direction of the axis. The inclined surface 45 extends around the entire outer circumferential surface of the elastic deformation member 42.

In the embodiment, the inclined surface 46 inclines by a predetermined angle toward inside in the direction of the diameter, from the middle portion to the proximal end portion of the elastic deformation member 42 in the direction of the axis. The inclined surface 46 extends around the entire outer circumferential surface of the elastic deformation member 42.

In the embodiment, the elastic deformation member 42 has a shape expanded at the middle portion thereof in the direction of the axis, with the inclined surfaces 45 and 46. Hereunder, a portion of the elastic deformation member 42 thus expanded in the middle portion thereof in the direction of the axis is called an expanded portion 42A.

In the embodiment, the sliding contact portions 47 and 48 are provided in the inner circumference at a proximal end side of the movable sleeve 21. The sliding contact portions 47 and 48 are situated in positions corresponding to the inclined surfaces 45 and 46 of the elastic deformation member 42, respectively.

More specifically, the sliding contact portion 47 is provided in a circumferential end portion at the distal end in the direction of the axis of the groove 43B formed in the inner circumferential surface in the proximal end portion of the movable sleeve 21. Similarly, the sliding contact portion 48 is provided in the circumferential end portion at the proximal end in the direction of the axis of the groove 43B formed in the inner circumferential surface in the proximal end portion of the movable sleeve 21.

When the movable sleeve 21 is in the initial position, the expanded portion 42A of the elastic deformation member 42 is situated between the sliding contact portions 47 and 48. Further, end portions of the sliding contact portions 47 and 48 are close to or contact with the inclined surfaces 45 and 46, respectively. At this point, the elastic deformation member 42 is not deformed; is slightly deformed inwardly in the direction of the diameter due to contact of an end portion of the expanded portion 42A with a bottom surface of the groove 43B; or is slightly deformed inwardly in the direction of the diameter due to contact of the sliding contact portions 47 and 48 with the inclined surface 45 and 46, respectively.

When the operator holds the holding portion 23 of the movable sleeve 21 with the fingers and applies force so that the movable sleeve 21 is pushed toward the distal end in the direction of the axis, the movable sleeve 21 is moved in the direction of the distal end from the initial position. Therefore, the sliding contact portion 48 is moved toward the distal end in the direction of the axis, contacting slidingly with the inclined surface 46.

As a result, the elastic deformation member 42 is considerably deformed inwardly in the direction of the diameter since the inclined surface 46 is pushed against the sliding contact portion 48. Further, when the fingers of the operator are taken off from the holding portion 23 of the movable sleeve 21, a force toward outside in the direction of the diameter to restore the shape of the elastic deformation member 42 is applied to the sliding contact portion 48 which is in contact with the inclined surface 46. Therefore, the sliding contact portion 48 is pushed toward the proximal end in the direction of the axis. Consequently, the movable sleeve 21 at the distal end side returns to the initial position thereof.

In addition, when the operator holds the holding portion 23 of the movable sleeve 21 with the fingers and applies force so that the movable sleeve 21 is pushed toward the proximal end in the direction of the axis, the movable sleeve 21 is moved in the direction of the proximal end from the initial position. Therefore, the sliding contact portion 47 is moved toward the proximal end in the direction of the axis, contacting slidingly with the inclined surface 45.

As a result, the elastic deformation member 42 is considerably deformed inwardly in the direction of the diameter since the inclined surface 45 is pushed against the sliding contact portion 47. Further, when the fingers of the operator are taken off from the holding portion 23 of the movable sleeve 21, a force toward inside in the direction of the diameter to restore the shape of the elastic deformation member 42 is applied to the sliding contact portion 47 which is in contact with the inclined surface 45. Therefore, the sliding contact portion 47 is pushed toward the distal end in the direction of the axis. Consequently, the movable sleeve 21 at the distal end side returns to the initial position thereof.

It is possible that the electrical connector 41 according to the second embodiment of the invention is able to obtain the same functionality and effect with the electrical connector 1 in the first embodiment of the present invention.

Third Embodiment

Figure 10:
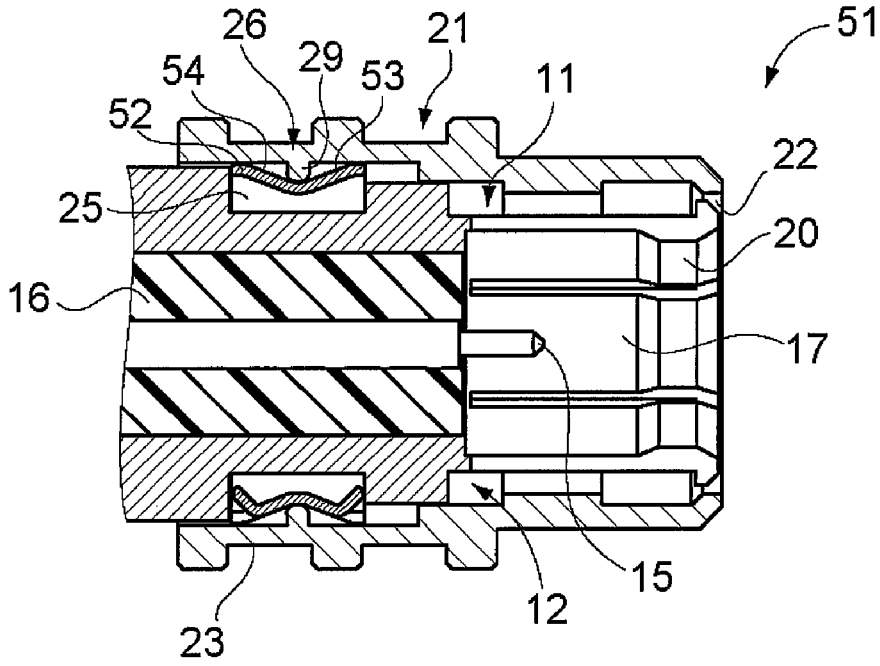
FIG. 10 is a sectional view showing an electrical connector according to a third embodiment of the present invention.

A third embodiment of the present invention will be explained next. FIG. 10 is a sectional view showing an electrical connector according to a third embodiment of the present invention. In FIG. 10, components unchanged from the first embodiment have the same numeral references as FIGS. 1 to 8(B) and explanations thereof will be omitted.

As shown in FIG. 10, the electrical connector 51 according to the third embodiment of the present invention includes an elastic deformation member 52 as a part of the mechanism for returning the movable sleeve 21 moved by the operator in the direction of the axis to the initial position automatically. In the embodiment, the elastic deformation member 52 is made from a metallic material by press working.

In the embodiment, the elastic deformation member 52 has a C-letter shape as a whole. The elastic deformation member 52 is capable of being deformed with elasticity thereof in the direction of the diameter thereof. The elastic deformation member 52 includes inclined surfaces 53 and 54 in the outer circumferential surface thereof.

In the embodiment, the inclined surface 53 inclines from the middle portion of the elastic deformation portion 52 to the distal end portion in the direction of the axis, and toward outside in the direction of a diameter. The inclined surface 54 inclines from the middle portion of the elastic deformation portion 52 to the proximal end portion in the direction of the axis, and toward outside in the direction of a diameter. Other configuration of the electrical connector 51 is the same with the configuration of the electrical connector 1 in the first embodiment of the present invention.

In addition, the electrical connector 51 has the same function with the electrical connector 1 in the first embodiment of the present invention, that is, the function to move the movable sleeve 21 to the initial position automatically, utilizing the force toward outside in the direction of the diameter generated as the elastic deformation member 52 restores the shape thereof after deformed inwardly in the direction of the diameter.

It is possible that the electrical connector 51 according to the third embodiment of the invention is able to obtain the same functionality and effect with the electrical connector 1 in the first embodiment of the present invention.

Fourth Embodiment

Figure 11:
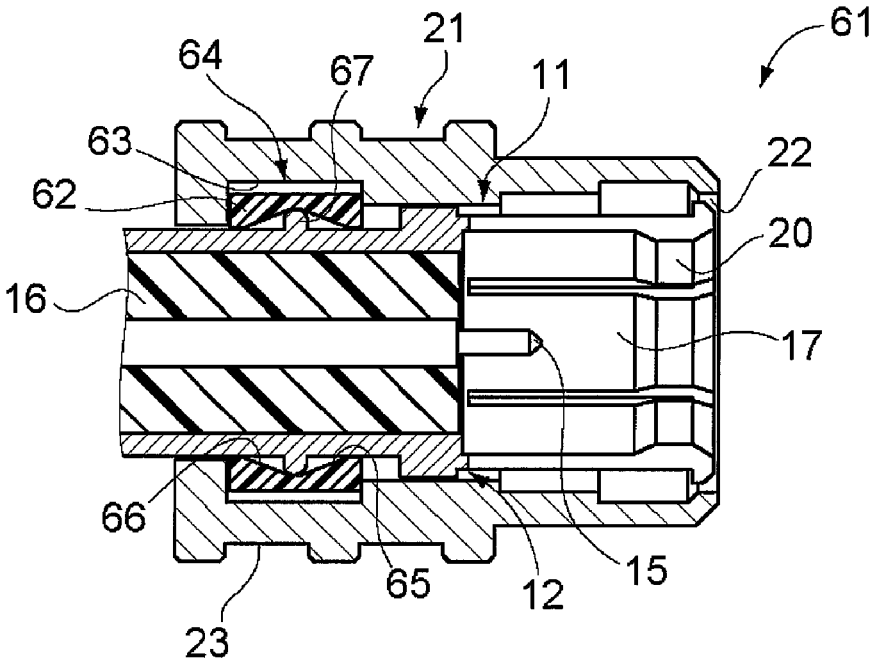
FIG. 11 is a sectional view showing an electrical connector according to a fourth embodiment of the present invention.

A fourth embodiment of the present invention will be explained next. FIG. 11 is a sectional view showing an electrical connector according to a fourth embodiment of the present invention. In FIG. 11, components unchanged from the first embodiment have the same numeral references as FIGS. 1 to 8(B) and explanations thereof will be omitted.

As shown in FIG. 11, the electrical connector 61 according to the fourth embodiment of the present invention includes an elastic deformation member 62 made from a resin material and has a C-letter shape as a whole. The elastic deformation member 62 is capable of being deformed outwardly in the direction of the diameter with elasticity thereof. Further, the electrical connector 61 further includes an accommodating portion 63 for accommodating the elastic deformation member 62. The accommodating portion 63 has a groove shape stretching in the circumferential direction in the inner surface of the movable sleeve 21 at the proximal end portion.

Furthermore, the electrical connector 61 includes a transmission unit 64 for generating a force bringing back the movable sleeve 21 to the initial position by utilizing elastic force of the elastic deformation member 62. The transmission unit 64 includes at least inclined surfaces 65 and 66, a sliding contact portion 67.

In other words, the elastic deformation member 62 includes the inclined surfaces 65 and 66 formed on the inner circumference of the elastic deformation member 62. The inclined surface 65 inclines from the middle portion of the elastic deformation portion 62 to the distal end portion in the direction of the axis, and toward inside in the direction of a diameter.

In the embodiment, the inclined surface 66 inclines from the middle portion of the elastic deformation portion 62 to the proximal end portion in the direction of the axis, and toward inside in the direction of a diameter. Further, the sliding contact portion 67 is provided in the outer circumferential surface at the proximal end side of the cylindrical member 12 of the connector main body 11. The sliding contact portion 67 extends toward outside in the direction of the diameter.

In the embodiment, the sliding contact portion 67 may extend around the entire outer circumference at the proximal end side of the cylindrical member 12 as an elongated protrusion. The sliding contact portion 67 also may be divided into a plurality of protruding pieces arranged in the outer circumference at the proximal end side of the cylindrical member 12 with a constant or inconstant interval in the circumferential direction.

When the movable sleeve 21 is in the initial position, an end portion of the sliding contact portion 67 is close to or contacts with the middle portion in the direction of the axis of the elastic deformation member 62, where the inclined surfaces 65 and 66 contacts with each other. At this point, the elastic deformation member 62 is not deformed or is slightly deformed in the direction of the diameter outwardly.

When the operator holds the holding portion 23 of the movable sleeve 21 with the fingers and applies force so that the movable sleeve 21 is pushed toward the distal end in the direction of the axis, the movable sleeve 21 is moved in the direction of the distal end from the initial position. Therefore, the elastic deformation portion 62 is moved in the direction of the distal end.

Accordingly, the sliding contact portion 67 contacts slidingly with the inclined surface 66. Thereby, the sliding contact portion 67 presses the inclined surface 66. As a result, the elastic deformation member 62 is considerably deformed outwardly in the direction of the diameter. Further, when the fingers of the operator are taken off from the holding portion 23 of the movable sleeve 21, a force toward inside in the direction of the diameter for restoring the shape of the elastic deformation member 62 is applied to the sliding contact portion 67 which is in contact with the inclined surface 66. Therefore, the sliding contact portion 67 is pushed toward the proximal end in the direction of the axis. Consequently, the movable sleeve 21 moved to the distal end side returns to the initial position thereof.

In addition, when the operator holds the holding portion 23 of the movable sleeve 21 with the fingers and applies force so that the movable sleeve 21 is pushed toward the proximal end in the direction of the axis, the movable sleeve 21 is moved in the direction of the proximal end from the initial position. Therefore, the elastic deformation portion 62 is moved in the direction of the proximal end. Accordingly, the sliding contact portion 67 contacts slidingly with the inclined surface 65. Thereby, the sliding contact portion 67 presses the inclined surface 65. As a result, the elastic deformation member 62 is considerably deformed outwardly in the direction of the diameter.

Further, when the fingers of the operator are taken off from the holding portion 23 of the movable sleeve 21, a force toward inside in the direction of the diameter for restoring the shape of the elastic deformation member 62 is applied to the sliding contact portion 67 which is in contact with the inclined surface 65. Therefore, the sliding contact portion 67 is pushed toward the distal end in the direction of the axis. Consequently, the movable sleeve 21 moved to the proximal end side returns to the initial position thereof.

It is possible that the electrical connector 61 according to the fourth embodiment of the invention is able to obtain the same functionality and effect with the electrical connector 1 in the first embodiment of the present invention.

Fifth Embodiment

Figure 12:
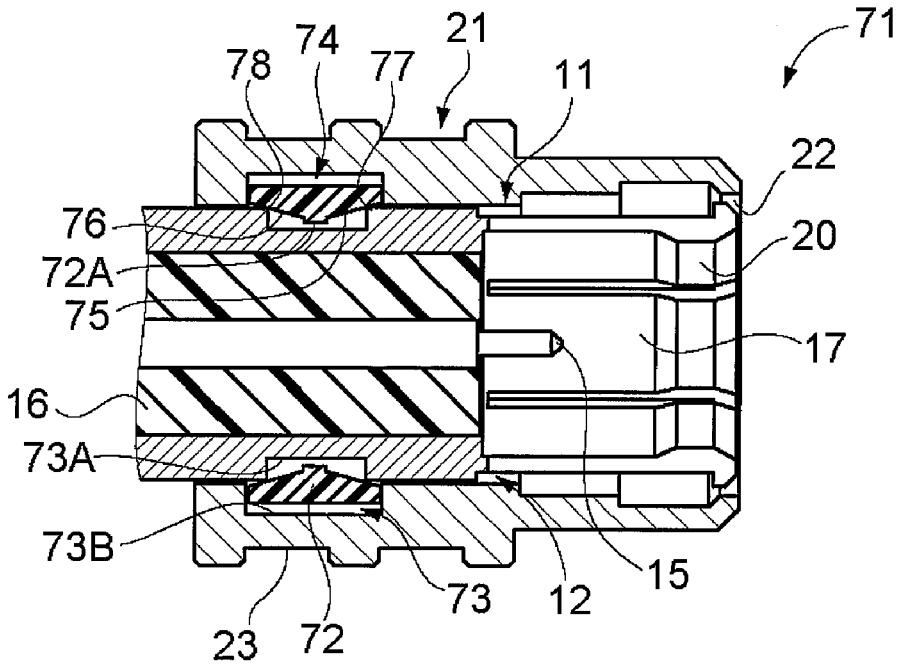
FIG. 12 is a sectional view showing an electrical connector according to a fifth embodiment of the present invention.

A fifth embodiment of the present invention will be explained next. FIG. 12 is a sectional view showing an electrical connector according to a fifth embodiment of the present invention. In FIG. 12, components unchanged from the first embodiment have the same numeral references as FIGS. 1 to 8(B) and explanations thereof will be omitted.

As shown in FIG. 12, the electrical connector 71 according to the fifth embodiment of the present invention includes an elastic deformation member 72. In the embodiment, the elastic deformation member 72 is made from a resin material and has a C-letter shape as a whole. The elastic deformation member 72 is capable of being deformed with elasticity thereof in the direction of the diameter thereof outwardly. An accommodating portion 73 for accommodating the elastic deformation member 72 therein includes grooves 73A and 73B.

In the embodiment, the groove 73A stretches in the circumferential direction around the outer circumferential surface in the proximal end portion of the cylindrical member 12 of the connector main body 11. The groove 73B stretches in the circumferential direction around an inner circumferential surface in the proximal end portion of the movable sleeve 21 so as to face the groove 73A.

In the embodiment, the transmission unit 74 generates the force to move the movable sleeve 21 to the initial position, utilizing the elasticity of the elastic deformation member 72. The transmission unit 74 includes at least inclined surfaces 75 and 76 and sliding contact portions 77 and 78. That is, elastic deformation member 72 includes the inclined surfaces 75 and 76 on an inner circumference thereof.

In the embodiment, the inclined surface 75 inclines from the middle portion to the distal end portion of the elastic deformation member 72 in the direction of the axis, toward outside in the direction of the diameter. The inclined surface 76 inclines from the middle portion to the proximal end portion of the elastic deformation member 72 in the direction of the axis, toward outside in the direction of the diameter.

In the embodiment, the elastic deformation member 72 has a shape expanded at the middle portion thereof inwardly in the direction of the axis, with the inclined surfaces 75 and 76. Hereunder, a portion of the elastic deformation member 72 thus expanded in the middle portion thereof in the direction of the axis is called an expanded portion 72A. Further, the cylindrical member 12 of the connector main body 11 includes a groove 73A in the inner circumference in the proximal end portion thereof. The sliding contact portion 77 is provided in a circumferential end portion at the distal end in the direction of the axis of the groove 73A. The sliding contact portion 78 is provided in the circumferential end portion at the proximal end in the direction of the axis of the groove 73A.

When the movable sleeve 21 is in the initial position, the expanded portion 72A of the elastic deformation member 72 is situated between the sliding contact portions 77 and 78. Further, end portions of the sliding contact portions 77 and 78 are close to or contact with the inclined surfaces 75 and 76, respectively. At this point, the elastic deformation member 72 is not deformed; is slightly deformed in the direction of the diameter inwardly due to contact of an end portion of the expanded portion 72A with a bottom surface of the groove 73A; or is slightly deformed in the direction of the diameter inwardly due to contact of the sliding contact portions 77 and 78 with the inclined surface 75 and 76, respectively.

When the operator holds the holding portion 23 of the movable sleeve 21 with the fingers and applies force so that the movable sleeve 21 is pushed toward the distal end, the movable sleeve 21 is moved in the direction of the distal end from the initial position. Therefore, the sliding contact portion 77 is moved toward the distal end in the direction of the axis, contacting slidingly with the inclined surface 75. As a result, the elastic deformation member 72 is considerably deformed outwardly in the direction of the diameter since the inclined surface 75 is pushed against the sliding contact portion 77.

Further, when the fingers of the operator are taken off from the holding portion 23 of the movable sleeve 21, a force toward inside in the direction of the diameter to restore the shape of the elastic deformation member 72 is applied to the sliding contact portion 77 which is in contact with the inclined surface 75. Therefore, the sliding contact portion 77 is pushed toward the proximal end in the direction of the axis. Consequently, the movable sleeve 21 moved to the distal end side returns to the initial position thereof.

In addition, when the operator holds the holding portion 23 of the movable sleeve 21 with the fingers and applies force so that the movable sleeve 21 is pushed toward the proximal end, the movable sleeve 21 is moved in the direction of the proximal end from the initial position. Therefore, the sliding contact portion 78 is moved toward the proximal end in the direction of the axis, contacting slidingly with the inclined surface 76. As a result, the elastic deformation member 72 is considerably deformed outwardly in the direction of the diameter since the inclined surface 76 is pushed against the sliding contact portion 78.

Further, when the fingers of the operator are taken off from the holding portion 23 of the movable sleeve 21, a force toward inside in the direction of the diameter to restore the shape of the elastic deformation member 72 is applied to the sliding contact portion 78 which is in contact with the inclined surface 76. Therefore, the sliding contact portion 78 is pushed toward the distal end in the direction of the axis. Consequently, the movable sleeve 21 moved to the proximal end side returns to the initial position thereof.

It is possible that the electrical connector 71 according to the fifth embodiment of the invention is able to obtain the same functionality and effect with the electrical connector 1 in the first embodiment of the present invention.

Sixth Embodiment

Figure 13:
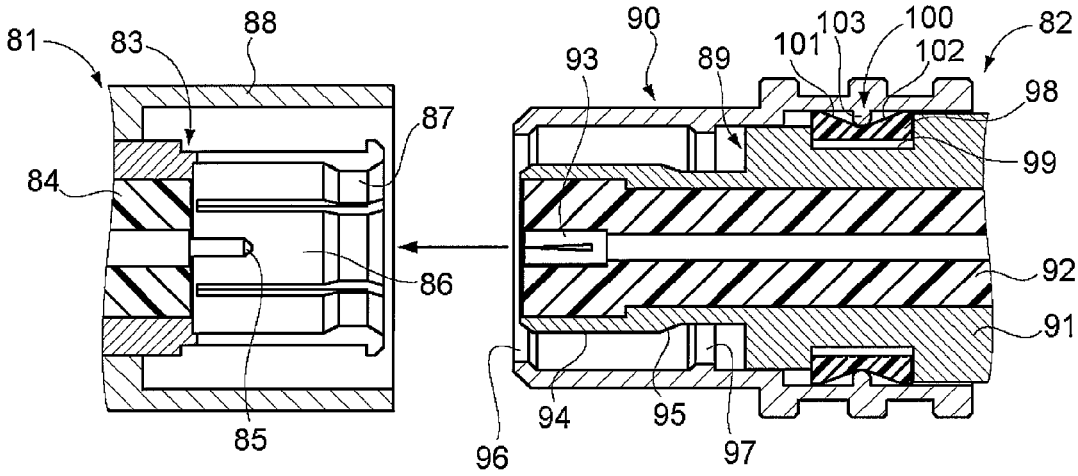
FIG. 13 is a sectional view showing a pair of electrical connectors according to a sixth embodiment of the present invention.

A sixth embodiment of the present invention will be explained next. FIG. 13 is a sectional view showing a pair of electrical connectors according to a sixth embodiment of the present invention. The pair of the electrical connectors includes a first electrical connector 81 (a first connector) and a second electrical connector 82 (a second connector) connected to each other.

The first connector 81 includes a cylindrical member 83 having a cylindrical shape; a central terminal 85 extending in the direction of the axis and fixed in the cylindrical member 83 with a supporting member 84; and a fitting portion 86 at a distal end portion of the cylindrical member 83, for receiving the second connector 82 upon being connected to the second connector 82.

In the embodiment, the fitting portion 86 is capable of expanding a diameter thereof elastically. Furthermore, the fitting portion 86 includes an engaging portion 87 in an inner circumference thereof. When the second connector 82 is inserted into the fitting portion 86, the fitting portion 86 expands the diameter thereof. Thereby the second connector 2 is able to be inserted into the fitting portion 86 further. When the second connector 82 is completely inserted into the fitting portion 86, the engaging portion 87 engages an engaged portion 95 provided in the second connector 82 as the fitting portion 86 restores a shape thereof to an initial shape.

In addition, the cylindrical member 83 further includes a reinforcement guide 88 on an outer circumference thereof. The reinforcement guide 88 has a cylindrical shape.

The second connector 82 is substantially configured with a connector main body 89 and a movable sleeve 90. The movable sleeve 90 is able to move against the connector main body 89 in the direction of the axis.

The connector main body 89 includes a cylindrical member 91 having a cylindrical shape and a central terminal 93 fixed in the cylindrical member 91 at the proximal side of the cylindrical member 91 with a supporting member 92. The central terminal 93 extends in the direction of the axis. Furthermore, the cylindrical member 91 includes an insertion portion 94 at a distal end portion thereof.

In the embodiment, the insertion portion 94 is inserted and fitted into the fitting portion 86 of the first connector 81. The second connector 82 further includes the engaged portion 95. The engaged portion 95 is situated at the proximal end on an outer circumferential surface of the insertion portion 94 of the cylindrical member 91.

In the embodiment, the movable sleeve 90 is formed in a cylindrical shape. The movable sleeve 90 includes diameter control portions 96 and 97 in a distal end portion and a middle portion thereof in the direction of the axis, respectively. The diameter control portions 96 and 97 control expansion of a diameter of the fitting portion 86 of the first connector 81.

When a distal end portion of the fitting portion 86 of the first connector 81 and a distal end portion of the insertion portion 94 of the second connector 82 contact with each other upon connecting the first connector 81 and the second connector 82 to each other, the diameter control portion 96 comes close or abuts to an outer circumference of the fitting portion 86 in a case that the movable sleeve 90 is situated in an initial position in the direction of the axis.

In the case described above, the fitting portion 86 is not allowed to expand the diameter thereof at the distal end. When the movable sleeve 90 is moved from the initial position to the distal end, the diameter control portion 96 becomes apart from the outer circumference of the fitting portion 86. Thereby, the fitting portion 86 is allowed to expand the diameter thereof.

In addition, when the insertion portion 94 of the second connector 82 is inserted completely into the fitting portion 86 of the first connector 81 and the first connector 81 and the second connector 82 are connected to each other, in other words, when the engaging portion 87 engages the engaged portion 95, the diameter control portion 97 comes close or abuts to the outer circumference of the fitting portion 86 in a case that the movable sleeve 90 is situated in the initial position in the direction of the axis.

In the case described above, the fitting portion 86 is not allowed to expand the diameter thereof at the distal end. When the movable sleeve 90 is moved to the proximal end, the diameter control portion 97 becomes apart from the outer circumference of the fitting portion 86. Thereby, the fitting portion 86 is allowed to expand the diameter thereof.

The second connector 82 includes an elastic deformation member 98; an accommodating portion 99; and a transmission unit 100 as a mechanism for enabling the movable sleeve 90 moved in the direction either of the proximal end or the distal end to return automatically to the initial position. The accommodating portion 99 accommodates the elastic deformation member 98 and the transmission unit 100 generates force bringing back the movable sleeve 90 to the initial position by utilizing elastic force of the elastic deformation member 98.

In the embodiment, the elastic deformation member 98 and accommodating portion 99 have the same configurations as the elastic deformation member 24 and accommodating portion 25 in the first embodiment, respectively. Further, the transmission unit 100 at least includes two inclined surfaces 101 and 102 formed on an outer circumference of the elastic deformation member 98 and a sliding contact portion 103 provided in the movable sleeve 90 having the same configurations with the inclined surfaces 27 and 28 and sliding contact portion 29 in the first embodiment of the present invention, respectively.

It is possible that the pair of the electrical connectors according to the sixth embodiment of the invention is able to obtain the same functionality and effect with the electrical connector 1 in the first embodiment of the present invention.

In the embodiments described above, according to the present invention, each of the electrical connectors 1, 41, 51, 61, 71, 81 and 82 is a coaxial connector having a single central terminal 15, 85 or 93. Electrical connectors according to the present invention are not limited to the electrical connectors described above. An electrical connector according to the present invention may be a multi core connector having a plurality of terminals in an inner circumference of an external terminal.

Furthermore, in the embodiments described above, according to the present invention, each of the electrical connectors 1, 41, 51, 61, 71, 81 and 82 has a circular cross-sectional shape. The present invention is applicable to an electrical connector having a polygonal cross-sectional shape, for example, a tetragonal cross-sectional shape, not limited to the circular cross-sectional shape.

Figure 14:
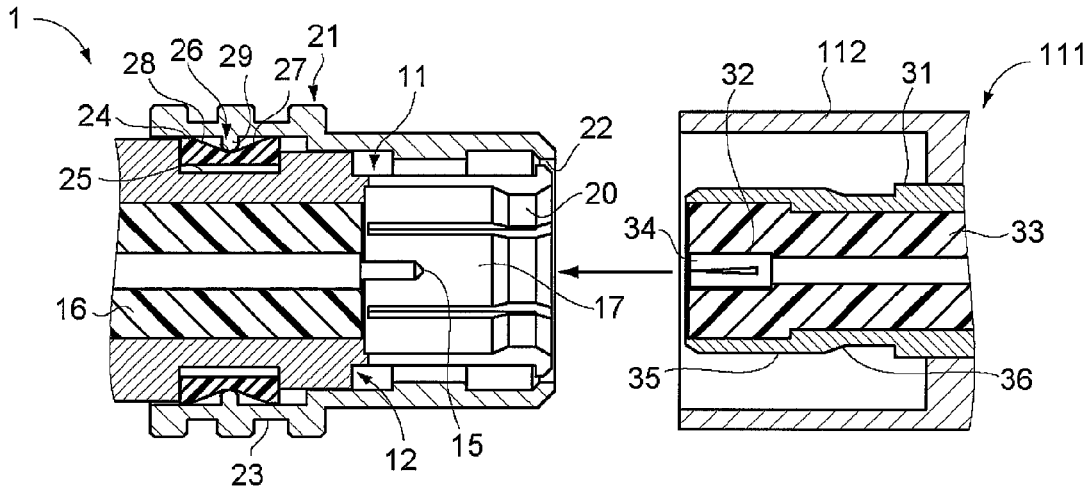
FIG. 14 is a sectional view showing a mating connector according to a modified example of the present invention.

Additionally, as shown in FIG. 14, a mating connector 111 may include a reinforcement guide 112. The reinforcement guide 112 has a cylindrical shape. The reinforcement guide 112 is settled so as to surround an entire outer circumference in a distal end portion of the movable sleeve 21 of the electrical connector 1 when the electrical connector 1 is connected to the mating connector 111. The reinforcement guide 112 protects the electrical connector 1 and the mating connector 111 from an external force applied to the electrical connector 1 and the mating connector 111 due to being twisted forcibly and the like. Consequently, the electrical connector 1 and the mating connector 111 are able to obtain higher durability.

Figure 15:
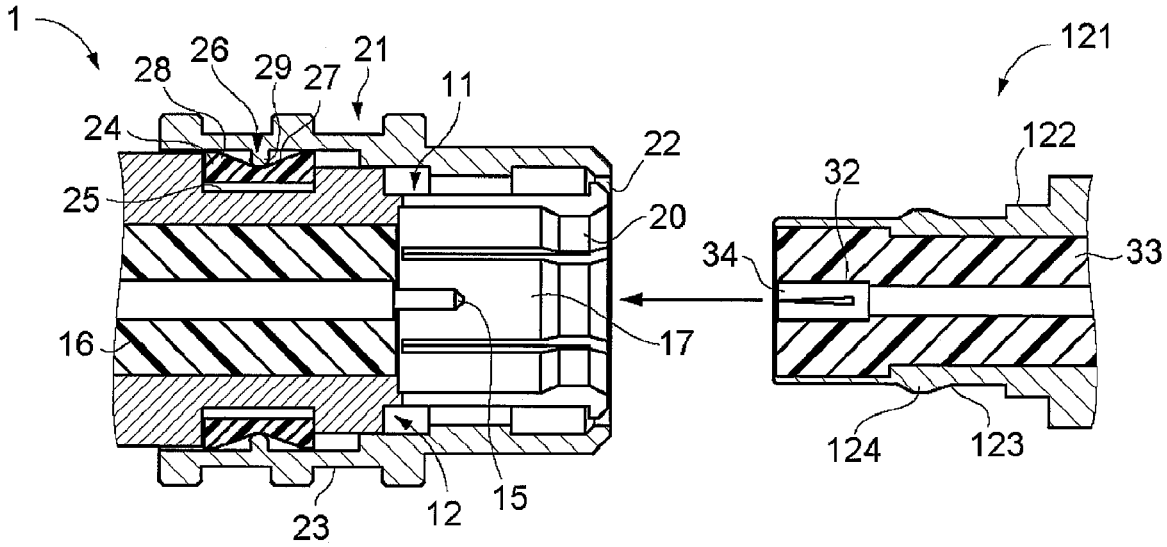
FIG. 15 is a sectional view showing a mating connector according to another modified example of the present invention.

Furthermore, as shown in FIG. 15, a mating connector 121 may include a bulging portion 124 situated next to an engaged portion 123 in a distal end portion of an outer cylindrical member 122. The bulging portion 124 bulges outwardly in the direction of the diameter throughout an entire outer circumference of the outer cylindrical member 122. An outer diameter of the distal end portion of the outer cylindrical member 122 is smaller than an outer diameter of the insertion portion 35 of the outer cylindrical member 31 shown in FIGS. 5 and 6.

With the configuration as described above, it is also possible to enable the fitting portion 17 to expand the diameter thereof since the bulging portion 124 pushes the engaging portion 20 outwardly in the direction of the diameter as the mating connector 121 enters the fitting portion 17 of the electrical connector 1. When the mating connector 121 completely enters the fitting portion 17 of the electrical connector 1, the fitting portion 17 is allowed to shrink the diameter thereof so as to obtain an initial shape. Therefore, it is possible for the engaging portion 20 to engage the engaged portion 123 of the mating connector 121.

In the embodiments described above, the present invention is applied to an electrical connector. It is possible to apply the present invention to an optical connector having an optical signal terminal, not limited to the embodiments described above.

Moreover, the present invention is able to modify as far as the modification is within the inventive concept readable from the claims and the specification as a whole. Therefore, the connector thus modified also falls within the inventive concept of the present invention.

The disclosure of Japanese Patent Application No. 2011-069657 filed on Mar. 28, 2011, is incorporated in the application by reference.

While the invention has been explained with reference to the specific embodiments of the invention, the explanation is illustrative and the invention is limited only by the appended claims.

What is claimed is:

1. A connector to be connected to a mating connector, comprising:

a connector main body including a cylindrical member, a supporting member disposed in the cylindrical member, a terminal supported on the supporting member, and a fitting portion arranged to be deformable in a radial direction thereof, said fitting portion having an engaging portion for engaging with the mating connector when the mating connector is completely inserted into the fitting portion;

a movable sleeve disposed around the connector main body to be movable along an axial direction thereof relative to the connector main body, said movable sleeve including a diameter control portion for controlling the fitting portion so that the fitting portion is not capable of expanding when the movable sleeve is situated at an initial position and the fitting portion is capable of expanding when the movable sleeve moves toward a distal end or a proximal end of the connector main body from the initial position;

an elastic deformation member disposed to be elastically deformable in a radial direction thereof;

an accommodating portion disposed between the connector main body and the movable sleeve for accommodating the elastic deformation member; and a transmission unit for transmitting a force in the axial direction from the movable sleeve to the elastic deformation member when the movable sleeve moves, and for transmitting a force in the radial direction from the elastic deformation member to the movable sleeve when the elastic deformation member returns to an original shape.

2. The connector according to claim 1, wherein said elastic deformation member is formed in a ring shape or a C character shape.

3. The connector according to claim 1, wherein said transmission unit includes a first inclined surface formed on an outer circumferential surface of the elastic deformation member, a second inclined surface formed on the outer circumferential surface of the elastic deformation member, and a sliding contact portion formed on an inner circumferential surface of the movable sleeve, said first inclined surface being inclined outwardly from a middle portion to a distal end portion of the elastic deformation member, said second inclined surface being inclined outwardly from the middle portion to a proximal end portion of the elastic deformation member, said sliding contact portion being arranged to slide against the first inclined surface when the movable sleeve moves toward the distal end of the connector main body from the initial position and slide against the second inclined surface when the movable sleeve moves toward the proximal end of the connector main body from the initial position.

4. The connector according to claim 1, wherein said transmission unit includes a first inclined surface formed on an outer circumferential surface of the elastic deformation member, a second inclined surface formed on the outer circumferential surface of the elastic deformation member, a first sliding contact portion formed on an inner circumferential surface of the movable sleeve, and a second sliding contact portion formed on the inner circumferential surface of the movable sleeve, said first inclined surface being inclined inwardly from a middle portion to a distal end portion of the elastic deformation member, said second inclined surface being inclined inwardly from the middle portion to a proximal end portion of the elastic deformation member, said first sliding contact portion being arranged to slide against the first inclined surface when the movable sleeve moves toward the distal end of the connector main body from the initial position, said second sliding contact portion being arranged to slide against the second inclined surface when the movable sleeve moves toward the proximal end of the connector main body from the initial position.

5. The connector according to claim 1, wherein said transmission unit includes a first inclined surface formed on an inner circumferential surface of the elastic deformation member, a second inclined surface formed on the inner circumferential surface of the elastic deformation member, and a sliding contact portion formed on an outer circumferential surface of the connector main body, said first inclined surface being inclined inwardly from a middle portion to a distal end portion of the elastic deformation member, said second inclined surface being inclined inwardly from the middle portion to a proximal end portion of the elastic deformation member, said sliding contact portion being arranged to slide against the second inclined surface when the movable sleeve moves toward the distal end of the connector main body from the initial position and slide against the first inclined surface when the movable sleeve moves toward the proximal end of the connector main body from the initial position.

6. The connector according to claim 1, wherein said transmission unit includes a first inclined surface formed on an inner circumferential surface of the elastic deformation member, a second inclined surface formed on the inner circumferential surface of the elastic deformation member, a first sliding contact portion formed on an outer circumferential surface of the connector main body, and a second sliding contact portion formed on the outer circumferential surface of the connector main body, said first inclined surface being inclined outwardly from a middle portion to a distal end portion of the elastic deformation member, said second inclined surface being inclined outwardly from the middle portion to a proximal end portion of the elastic deformation member, said first sliding contact portion being arranged to slide against the first inclined surface when the movable sleeve moves toward the distal end of the connector main body from the initial position, said second sliding contact portion being arranged to slide against the second inclined surface when the movable sleeve moves toward the proximal end of the connector main body from the initial position.

7. A connector, comprising:

a first connector; and a second connector connected to the first connector, wherein said first connector includes, a first cylindrical member;

a first supporting member disposed in the first cylindrical member;

a first terminal supported on the first supporting member; and a fitting portion arranged to be deformable in a radial direction thereof, said fitting portion having an engaging portion for engaging with the second connector when the second connector is completely inserted into the fitting portion, and said second connector includes, a connector main body including a second cylindrical member, a second supporting member disposed in the second cylindrical member, a second terminal supported on the second supporting member, and an engaged portion for engaging with the engaging portion when the second connector is completely inserted into the fitting portion;

a movable sleeve disposed around the connector main body to be movable along an axial direction thereof relative to the connector main body, said movable sleeve including a diameter control portion for controlling the fitting portion so that the fitting portion is not capable of expanding when the movable sleeve is situated at an initial position and the fitting portion is capable of expanding when the movable sleeve moves toward a distal end or a proximal end of the connector main body from the initial position;

an elastic deformation member disposed to be elastically deformable in a radial direction thereof;

an accommodating portion disposed between the connector main body and the movable sleeve for accommodating the elastic deformation member; and a transmission unit for transmitting a force in the axial direction from the movable sleeve to the elastic deformation member when the movable sleeve moves, and for transmitting a force in the radial direction from the elastic deformation member to the movable sleeve when the elastic deformation member returns to an original shape.

* * * * *